US007184688B2

(12) United States Patent
Ishii

(10) Patent No.: US 7,184,688 B2
(45) Date of Patent: Feb. 27, 2007

(54) IMAGE FORMING APPARATUS

(75) Inventor: Masahiro Ishii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 44 days.

(21) Appl. No.: 10/799,682

(22) Filed: Mar. 15, 2004

(65) Prior Publication Data

US 2004/0179859 A1 Sep. 16, 2004

(30) Foreign Application Priority Data

Mar. 14, 2003 (JP) ..... 2003-070561

(51) Int. Cl.
*G03G 21/18* (2006.01)

(52) U.S. Cl. ..... 399/113; 399/119

(58) Field of Classification Search ..... 399/113, 399/119, 112

See application file for complete search history.

(56) References Cited

U.S. PATENT DOCUMENTS

| | | | | |
|---|---|---|---|---|
| 5,845,176 | A | 12/1998 | Yoshida et al. | |
| 6,041,203 | A | 3/2000 | Suzuki et al. | |
| 6,101,350 | A | 8/2000 | Suzuki et al. | |
| 6,330,410 | B1 | 12/2001 | Okabe et al. | |
| 6,411,789 | B1 | 6/2002 | Okabe et al. | |
| 6,546,217 | B2 | 4/2003 | Okabe et al. | |
| 6,690,903 | B2 | 2/2004 | Okabe et al. | |
| 6,708,011 | B2 * | 3/2004 | Nomura et al. | 399/110 |
| 6,798,430 | B2 | 9/2004 | Sato | |
| 6,873,810 | B2 | 3/2005 | Okabe et al. | |
| 6,879,792 | B2 * | 4/2005 | Carter et al. | 399/113 |
| 6,944,415 | B2 * | 9/2005 | Nomura | 399/111 |
| 7,002,608 | B2 | 2/2006 | Sato | |
| 2001/0019418 | A1 | 9/2001 | Kataoka et al. | |
| 2001/0055499 | A1 | 12/2001 | Sato | |
| 2005/0135837 | A1 | 6/2005 | Okabe et al. | |
| 2006/0056876 | A1 | 3/2006 | Okabe et al. | |
| 2006/0056877 | A1 | 3/2006 | Okabe et al. | |
| 2006/0056878 | A1 | 3/2006 | Okabe et al. | |

FOREIGN PATENT DOCUMENTS

| | | |
|---|---|---|
| EP | 1 273 980 A2 | 1/2003 |
| JP | A 59-34555 | 2/1984 |
| JP | U 63-45556 | 3/1988 |
| JP | A 2-302766 | 12/1990 |
| JP | A 02-302766 | 12/1990 |
| JP | A 8-54786 | 2/1996 |
| JP | A 10-78739 | 3/1998 |
| JP | A 11-38721 | 2/1999 |
| JP | A 2000-267547 | 9/2000 |
| JP | A 2001-166555 | 6/2001 |

(Continued)

*Primary Examiner*—Louis M. Arana
(74) *Attorney, Agent, or Firm*—Oliff & Berridge, PLC

(57) ABSTRACT

An image forming apparatus, includes: a mainframe; a developing unit including a developing agent container that contains a developing agent and a developing agent carrier that carries the developing agent; and an image carrying unit including an image carrier that carries a developing agent image formed by an electrostatic latent image being developed by the developing agent carried on the developing agent carrier. The developing unit is attachable to and detachable from the image carrying unit. The developing unit is loadable in and unloadable from the mainframe in a state where the developing unit is integrally attached to the image carrying unit.

24 Claims, 11 Drawing Sheets

FOREIGN PATENT DOCUMENTS

| | | |
|---|---|---|
| JP | A 2001-249517 | 9/2001 |
| JP | A 2001-249601 | 9/2001 |
| JP | A 2001-356548 | 12/2001 |
| JP | A 2001-356550 | 12/2001 |
| JP | A 2001-72602 | 3/2002 |

* cited by examiner

IMAGE FORMING APPARATUS

BACKGROUND OF THE INVENTION

1. Field of the Invention

The present invention relates to an image forming apparatus such as a color laser printer.

2. Background Art

As an electrophotographic color laser printer, a so-called tandem color laser printer is known where process units including toner boxes, developer rollers and photosensitive drums are plurally disposed in correspondence to toners of the respective colors of yellow, magenta, cyan and black.

In this tandem color laser printer, toners of the respective colors accommodated in the toner boxes are supplied to the photosensitive drums by the developer rollers in the process units so that toner images of the respective colors are formed at substantially the same time on the photosensitive drums. Thus, color images can be formed at substantially the same speed as in a monochrome laser printer.

In this tandem color laser printer, as described for example in JP-A-2002-72602, the toner box, the developer roller and the photosensitive drum are integrally disposed in each process unit, and each process unit is replaced when the toner box runs out of toner.

SUMMARY OF THE INVENTION

However, because the photosensitive drum also ends up being replaced each time the toner box becomes empty when the process units are replaced each time the toner boxes become empty, drawbacks arise in that running costs rise and industrial waste increases.

An image forming apparatus is disclosed herein that can reduce running costs and is environmentally sound.

According to an aspect of the invention, an image forming apparatus, includes: a mainframe; a plurality of developing units, each corresponding to a plurality of colors and each including a developing agent container that contains a developing agent and a developing agent carrier that carries the developing agent; and a plurality of image carrying units disposed correspondingly to the plurality of developing units and each including an image carrier that carries a developing agent image formed by an electrostatic latent image being developed by the developing agent carried on the developing agent carrier; wherein each of the developing units is attachable to and detachable from the corresponding image carrying unit; and the developing units are loadable in and unloadable from the mainframe in a state where the developing units are integrally attached to the image carrying units.

According to this aspect, the developing unit can be attached to and detached from the image carrying unit. Thus, when the developing unit runs out of toner, the used developing unit can be separated from the image carrying unit and a new developing unit can be attached to the image carrying unit, whereby it is possible to replace only the developing unit, whose replacement frequency is high. As a result, running costs and industrial waste can be reduced. Also, when the image carrying unit is to be replaced, the developing unit and the image carrying unit are removed as one unit from the image forming apparatus, the use image carrying unit is separated from the developing unit, the developing unit is attached to a new image carrying unit, and these are loaded as one unit in the image forming apparatus, whereby it is possible to easily replace the image carrying unit, whose replacement frequency is low.

According to another aspect of the invention, an image forming apparatus, includes: a mainframe; an image carrier that carries a developing agent image formed by an electrostatic latent image being developed by a developing agent and that is loadable in and unloadable from the mainframe; a transfer unit that transfers the developing agent image carried on the image carrier to a transfer medium at a transfer position; a shutter member movable between a cover position where the shutter member covers the transfer position facing the transfer unit in the image carrier and an exposure position where the shutter member exposes the transfer position; a second opening/closing member that supports the transfer unit, the second opening/closing member provided at the mainframe so as to be openable and closeable; and a shutter moving unit that moves the shutter member to the exposure position when the second opening/closing member is closed and moves the shutter member to the cover position when the second opening/closing member is open.

Preferably, the mainframe includes an opening and a first opening/closing member disposed at the opposite side of the transfer position with respect to the image carrier, so as to open and close the opening; the image carrier is loadable in and unloadable from the mainframe through the opening; and, when the image carrier is loaded through the opening in a state where the second opening/closing member is closed, the shutter moving unit moves the shutter member to the exposure position.

According to this aspect, when the second opening/closing member is open, the shutter member is moved to the covering position by the shutter moving unit, and when the second opening/closing member is closed, the shutter member is moved to the exposure position by the shutter moving unit. Additionally, when the image carrier is loaded through the opening formed by opening the first opening/closing member when the second opening/closing member is closed, the shutter member is moved to the exposure position by the shutter moving unit. Thus, the image carrier can be prevented from being exposed in the space formed by the opening of the second opening/closing member, so that damage to and deterioration of the image carriers can be prevented. Also, the image carrier is made to face the transfer unit supported at the second opening/closing member at the transfer position, so that it becomes possible for the transfer operation to be conducted.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
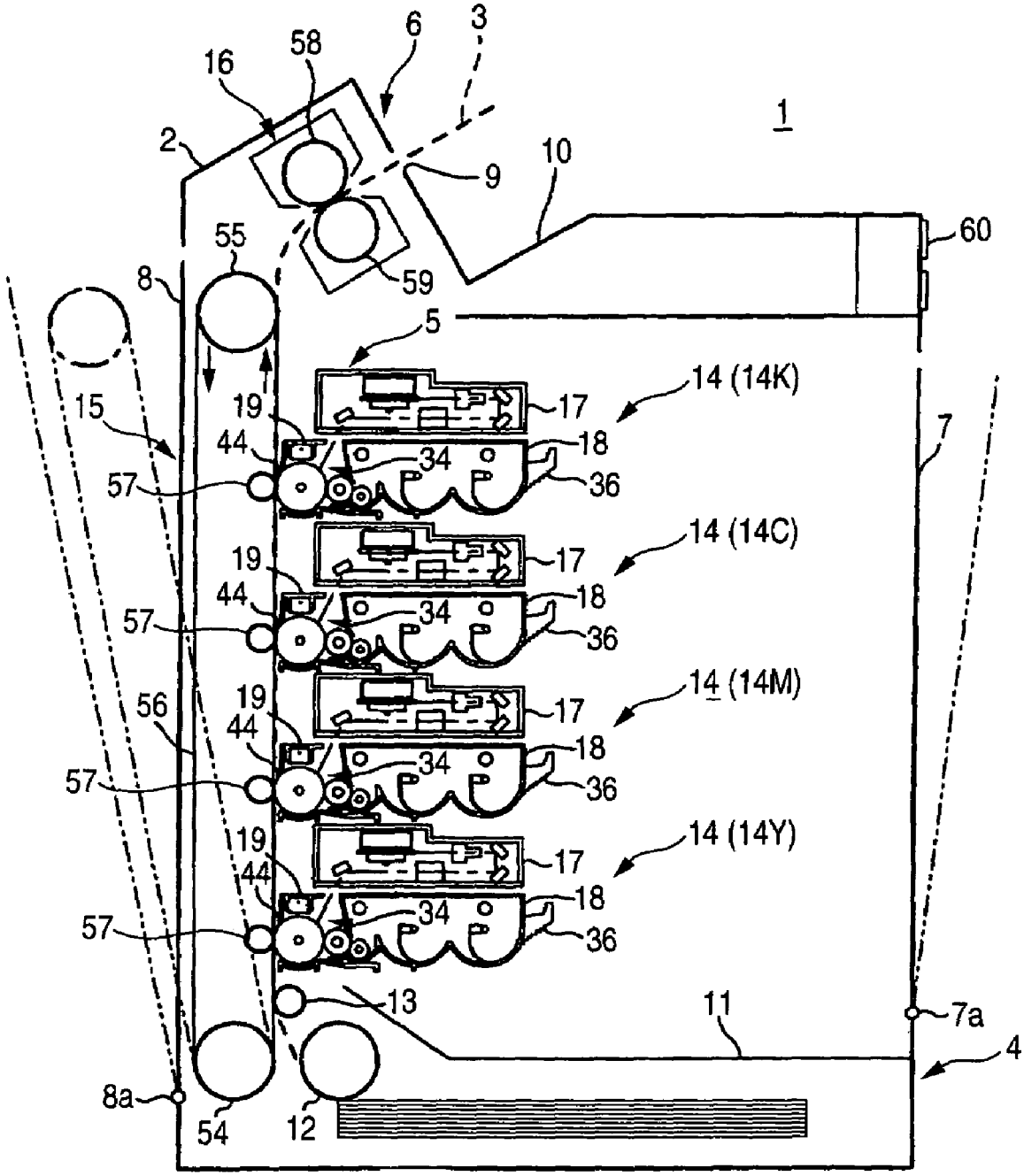
FIG. 1 is a sectional side view showing an embodiment of a color laser printer functioning as an image forming apparatus of the present invention.

FIG. 1 is a sectional side view showing an embodiment of a color laser printer 1 serving as an image forming apparatus of the present invention.

The color laser printer 1 in FIG. 1 includes a mainframe casing 2 that serves as an image forming apparatus mainframe. Within the mainframe casing 2 are disposed a paper supply section 4 for supplying paper 3, which serves as a transfer medium and a recording medium, an image forming section 5 for forming images on the supplied paper 3, and a paper discharge section 6 for discharging the paper 3 on which the images have been formed.

The mainframe casing 2 is formed in a substantially rectangular box shape, and a front cover 7 serving as a first opening/closing member is disposed at the front side thereof (below, the side of the color laser printer 1 at which an operation panel 60 is disposed in a substantially horizontal direction will be referred to as the front side, and the side at which a transfer unit 15 is disposed will be referred to as the rear side). A lower end portion of the front cover 7 is pivotably supported via a hinge 7*a* so that the front cover 7 can be opened and closed with respect to the mainframe casing 2, as shown by the imaginary line.

Also, a rear cover 8 serving as a second opening/closing member is disposed at the rear side of mainframe casing 2. A lower end portion of the rear cover 8 is pivotably supported via a hinge 8*a* so that the rear cover 8 can integrally move with the later-described transfer unit 15 and can be opened and closed with respect to the mainframe casing 2, as shown by the imaginary line.

A paper discharge port 9, which serves as recording medium discharging means for discharging the paper 3, and a concave paper discharge tray 10, which is deeply recessed at the paper discharge port 9 side so that the paper 3 discharged through the paper discharge port 9 is stacked, are disposed at an upper portion of the mainframe casing 2.

Also, the operation panel 60 for operating the color laser printer 1 is disposed on the mainframe casing 2 below a front end portion of the paper discharge tray 10.

The paper supply section 4 is disposed, at a bottom portion inside the mainframe casing 2, with a paper supply tray 11 that serves as recording medium accommodating means and is detachably loaded in a substantially horizontal direction from the front side with respect to the mainframe casing 2, a paper supply roller 12 disposed above an end portion (at the rear side) of the paper supply tray 11, and a conveyance roller 13 that is disposed above the paper supply roller 12 and faces a later-described conveyor belt 56 further upstream in the conveyance direction from a lowermost yellow process unit 14Y.

Sheets of the paper 3 are stacked inside the paper supply tray 11. The uppermost sheet of paper 3 is supplied one sheet at a time by the rotation of the paper supply roller 12 towards the conveyance roller 13 above the paper supply tray 11 in a substantially vertical direction, so that the sheets of paper 3 are successively supplied from the conveyance roller 13 to positions (transfer positions) between the conveyor belt 56 and the photosensitive drums 44.

The image forming section 5 is disposed with process units 14, the transfer unit 15, which serves as transfer means, and a fixing unit 16.

The process units 14 are disposed per color. That is, the process units 14 comprise the four units of the yellow process unit 14Y, a magenta process unit 14M, a cyan process unit 14C and a black process unit 14K. The process units 14 are successively disposed, at predetermined intervals from bottom to top, in parallel so that they are in line in a substantially vertical direction.

Each process unit 14 is disposed with a scanner unit 17 serving as exposure means, a developing unit 18 serving as a developing unit, and a photosensitive drum unit 19 serving as an image carrying unit.

Figure 2A:
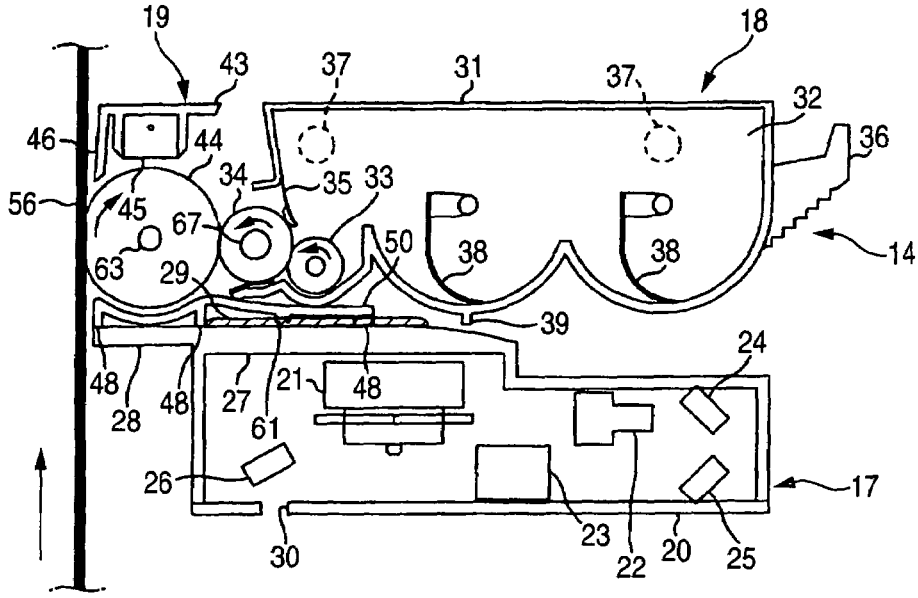
FIGS. 2A and 2B are enlarged sectional side views of constituent parts shown in FIG. 1, with FIG. 2A showing a state where a photosensitive drum unit is loaded in a mainframe casing in a state where a developing unit is attached with respect to the photosensitive drum unit and FIG. 2B showing a state where the developing unit is separated from the photosensitive drum unit in a state where the photosensitive drum unit is loaded with respect to the mainframe casing.

Each scanner unit 17 is disposed at a predetermined interval away from the conveyor belt 56 in a substantially horizontal direction and fixed to the mainframe casing 2. As shown in FIG. 2A, each scanner unit 17 includes a scanner casing 20 serving as a casing within which are disposed a laser emitter (not shown), a polygon mirror 21, two lenses 22 and 23, and three reflective mirrors 24, 25 and 26.

The scanner casing 20 is formed in a substantially long and thin box shape. A scanner-side guide portion 28 for guiding the photosensitive drum unit 19 at the time the photosensitive drum unit 19 is loaded and unloaded is integrally formed with a top wall of the scanner casing 20. The scanner-side guide portion 28 is disposed at the top wall so as to extend towards the vicinity of the conveyor belt 58 from a substantially horizontal-direction midpoint of the scanner casing 20. A front end portion of the scanner-side guide portion 28 is formed so as to gradually swell upward and rearward.

Figure 3:
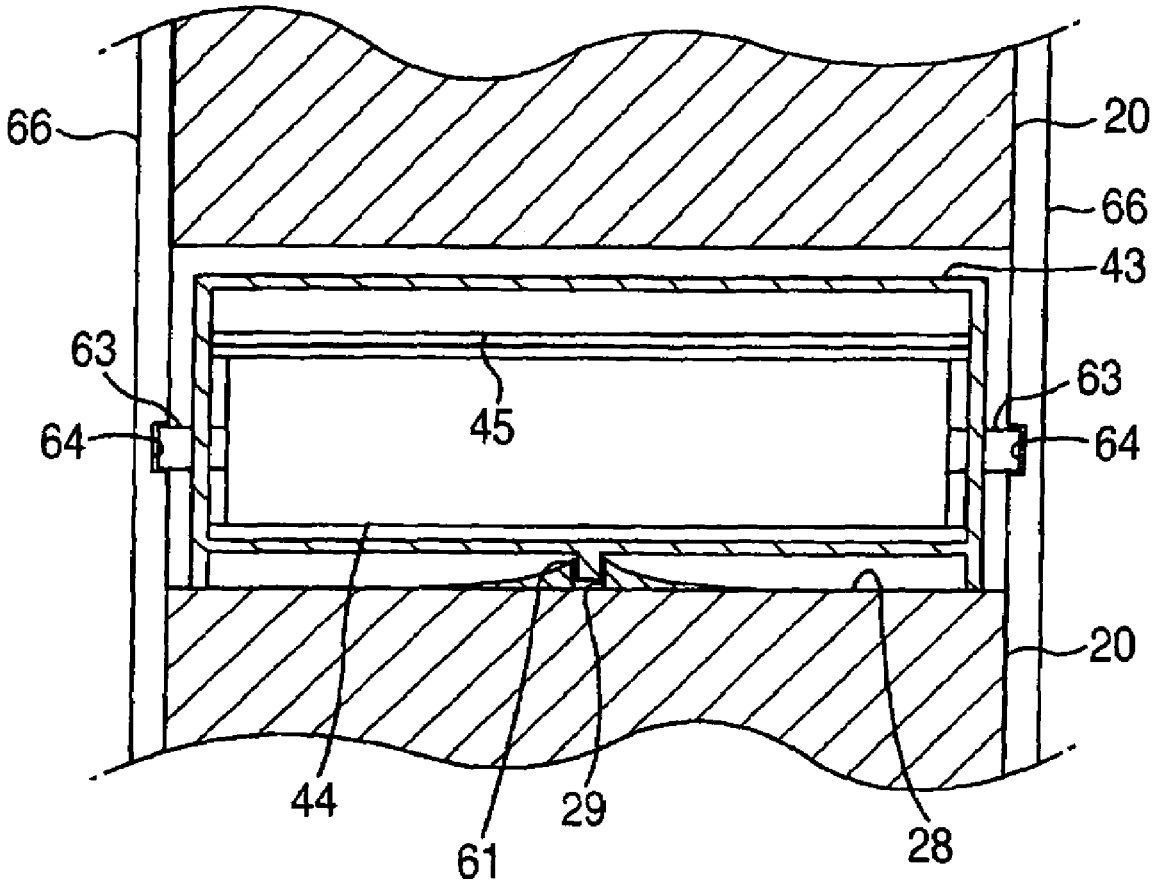
FIG. 3 is a front sectional view of the color laser printer shown in FIG. 1.

Also, as shown in FIG. 3, a guide groove 29, with which a boss portion 61 of a cover portion 47 of a later-described drum casing 43 slidably engages, is formed in a substantially central portion in the width direction (the direction orthogonal to the front-rear direction when seen in plan view; same below) of the scanner-side guide portion 28 so as to protrude upward in a substantially concave shape.

Figure 2B:
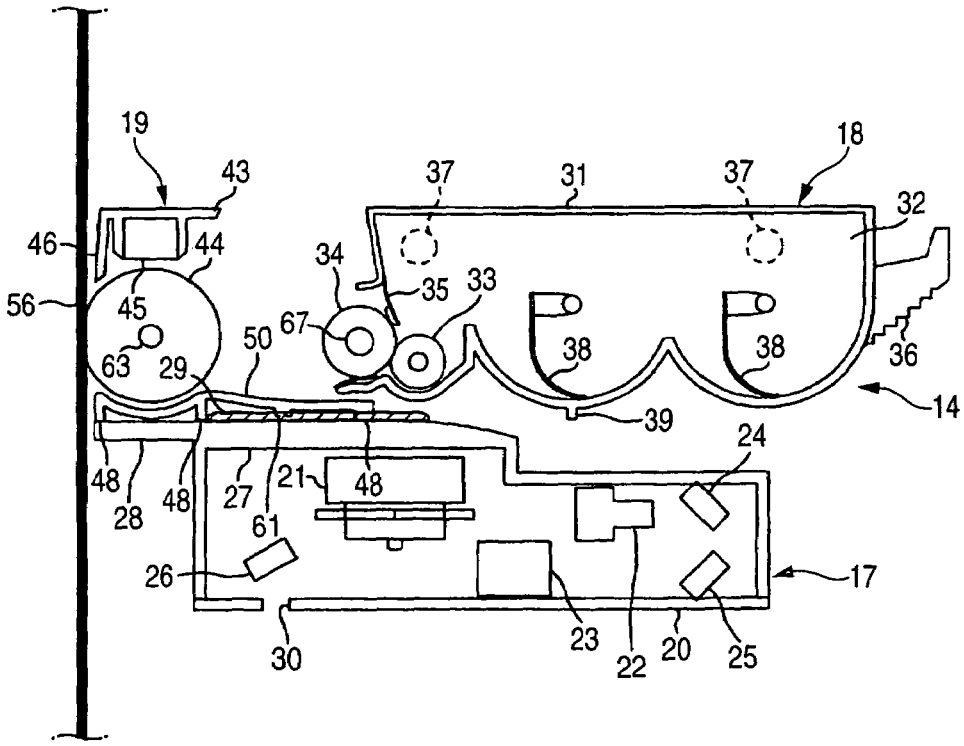

Also, as shown in FIGS. 2A and 2B, a bottom wall of the scanner casing 20 is formed in a substantially planar shape, and an emission window 30 through which a laser beam is emitted is formed in the vicinity of a rear end portion of the bottom wall.

Additionally, in each scanner unit 17, a laser beam (see the chain lines in FIG. 1) that is based on image data and emitted from the laser emitter is reflected by the polygon mirror 21, successively passes through or is reflected by the reflective mirror 24, the reflective mirror 25, the lens 23 and the reflective mirror 26 and is emitted through the emission window 30. The laser beams emitted through the emission windows 30 are irradiated at a scanning speed onto the photosensitive drums 44.

Also, the scanner units 17 are disposed in line in a substantially vertical direction. Specifically, the scanner units 17 are respectively disposed above the developing units 18 in correspondence to the developing units 18. In other words, the developing units 18 and the scanner units 17 are disposed so as to alternate in line in a substantially vertical direction.

As shown in FIGS. 2A and 2B, each developing unit 18 includes a developer casing 31 within which are disposed a toner hopper 32 serving as a developing agent accommodating portion, a supply roller 33, a developer roller 34 serving as a developing agent carrier, and a layer thickness regulating blade 35.

The developing unit 18 is disposed so that the developer roller 34, the supply roller 33 and agitators 38 are in line in a substantially horizontal direction, and each developing unit 18 is detachably loaded in a substantially horizontal direction with respect to the mainframe casing 2.

Figure 4A:
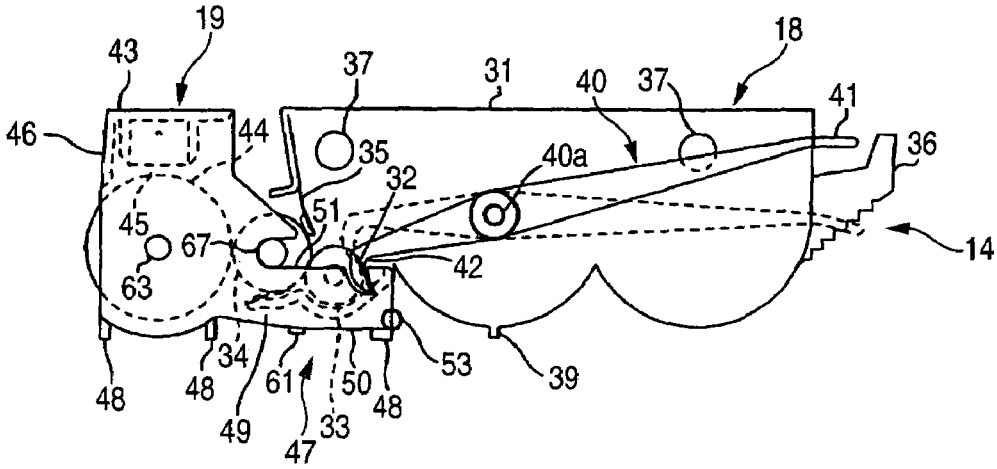
FIGS. 4A and 4B are side views showing the photosensitive drum unit and the developing unit of the color laser printer shown in FIG. 1, with FIG. 4A showing a state where the developing unit is attached with respect to the photosensitive drum unit and FIG. 4B showing a state where the developing unit is separated with respect to the photosensitive drum unit.

As shown in FIGS. 2A and 4A, the developer casing 31 is formed in a substantially long and thin box shape whose rear side is open. A grip portion 36 for gripping the developer casing 31 is disposed at a front wall of the developer casing 31. The grip portion 36 is formed so as to project frontward in a substantially triangular shape when seen in side view, with a lower surface of the grip portion 36 being formed in a saw-like manner so that it can be firmly and easily gripped by hand.

A top wall of the developer casing 31 is formed in a substantially planar shape that is parallel to the bottom wall of the scanner casing 20 formed in a substantially planar shape.

Also, a bottom wall of the developer casing 31 is formed in a wave-like manner with two continuous arcs in side view along the rotational locus of the two agitators 38 disposed inside the toner hopper 23. Moreover, a rear end portion of the bottom wall serves as a receiving portion for the supply roller 33 and the developer roller 34. Also, an abutment portion 39 that projects downward is disposed in the vicinity of a position in the bottom wall corresponding to the agitator 38 that is closest to the developer roller 34. The abutment portion 39 is formed as a protruding shape that extends in the width direction of the developer casing 31.

Also, developer-side guide protrusions 37, which serve as engagement members that slidably engage with later-described mainframe-side first guide grooves 62 of the mainframe casing 2, are disposed at both width-direction side walls of the developer casing 31. The developer-side guide protrusions 37 are formed in both side walls of the developer casing 31 so as to respectively project, in a substantially horizontal direction, from both width-direction outer sides in the vicinity of a position corresponding to the development roller 34 and the vicinity of a position corresponding to the agitator 38 that is farthest from the development roller 34.

Also, an engagement lever 40 serving as an engaged portion is disposed at both side walls of the developer casing 31. Each engagement lever 40 has a rod-like shape that extends in the front-rear direction. A front end portion of each engagement lever 40 is formed as a tabular operational portion 41, and a rear end portion of each engagement lever 40 is formed as a hook-like pawl portion 42 that is engageable with lock grooves 52 formed in side plates 49 of a later-described drum casing 45. The engagement levers 40 are pivotably supported at a rotating shaft 40*a* disposed so as to project from both width-direction outer sides of both side walls in the vicinity of a position corresponding to the agitator 38 that is closest to the development roller 34 in both side walls. Each engagement lever 40 is urged, by an unillustrated spring serving as urging means disposed in the developer casing 31, in a direction in which the pawl portion 42 engages with the lock groove 52 (i.e., a counter-clockwise direction in FIG. 4A).

As shown in FIGS. 2A and 2B, the toner hopper 32 is formed as a space inside the developer casing 31. The two agitators 38, which serve as developing agent conveyance members and are disposed with a predetermined interval therebetween in a substantially horizontal direction, are disposed in the toner hopper 32, and toners serving as developing agents of the respective colors are accommodated in the toner hoppers 32. That is, positively-charged non-magnetic single-component polymerized toners are respectively accommodated, in each process unit 14, as toners inside the toner hoppers 32, so that yellow toner is accommodated in the yellow process unit 14Y, magenta toner is accommodated in the magenta process unit 14M, cyan toner is accommodated in the cyan process unit 14C, and black toner is accommodated in the black process unit 14K. Because these polymerized toners are produced by suspension polymerization or emulsion polymerization, they are substantially spherical and have extremely excellent fluidity.

The supply roller 33 is formed by a metal roller shaft that is covered with a roller comprising a conductive sponge member. The supply roller 33 is supported so as to be rotatable in a clockwise direction and so as to rotate in the direction opposite to that of the developer roller 34 in a nip portion where the supply roller 33 faces and contacts the development roller 34.

The developer roller 34 is disposed behind the supply roller 33 in a state where it is mutually compressed with the supply roller 33. The developer roller 34 is formed by a metal shaft 67 serving as a guided portion that is covered with a roller comprising an elastic member such as a conductive rubber material. Specifically, the developer roller 34 is formed by a two layer structure of an elastic roller portion comprising silicone rubber or EPDM rubber and a coating layer that covers the surface of the roller portion and whose main component is urethane rubber, urethane resin or polyimide resin.

The roller shaft 67 of the developer roller 34 is supported, in the vicinity of rear end portions of later-described drum-side guide grooves 51 (see FIGS. 4A and 4B) of the drum casing 43, so that the developer roller 34 is rotatable in a counter-clockwise direction and rotates in the opposite direction of the photosensitive drum 44 at a nip portion where the developer roller 34 faces and contacts the photosensitive drum 44. That is, the roller shaft 67 of the developer roller 34 is disposed so as to project from both outer width-direction sides and slidably engages with the later-described drum-side guide grooves 51. Also, a developer bias is applied from an unillustrated power source at the time of development.

The layer thickness regulating blade 35 includes a blade body comprising a metal plate spring member having disposed at a tip end portion thereof a cross-sectionally semi-circular press portion comprising insulative silicone rubber. A base end portion of the blade body of the layer thickness regulating blade 35 is supported at the developer casing 31 above the space between the supply roller 33 and the developer roller 34. The press portion disposed at the tip end portion of the blade body faces and contacts the developer roller 34 and is made to press an upper side portion of the developer roller 34 by the elastic force of the blade body.

The toner accommodated inside the toner hopper 32 is conveyed through the toner hopper 32 from the front side to the rear side of the toner hopper 32 by the rotation of the two agitators 38 and supplied to the supply roller 33. The toner supplied to the supply roller 33 is supplied to the developer roller 34 by the rotation of the supply roller 33 and is positively frictionally charged at this time between the supply roller 33 and the developer roller 34. Moreover, the toner supplied onto the developer roller 34 enters the space between the press portion of the layer thickness regulating blade 35 and the developer roller 34 in accompaniment with the rotation of the developer roller 34 and is carried on the developer roller 34 as a thin layer of a fixed thickness.

Also, the developing units 18 are mutually disposed in line in the vertical direction. Specifically, as described above, the developing units 18 and the scanner units 17 are disposed so as to alternate in line in the vertical direction above the paper supply tray 11.

Each photosensitive drum unit 19 is loaded so as to be loadable and unloadable with respect to the mainframe casing 2 and includes the drum casing 43 within which are disposed the photosensitive drum 44 serving as an image carrier and a scorotron charger 45.

As shown in FIGS. 2A and 4A, the drum casing 43 includes a drum accommodating portion 46 and a cover portion 47 that are integrally formed. The drum accommodating portion 46 has a substantially rectangular rod-like shape with an opening formed therein so as to penetrate the drum accommodating portion 46 in the front-rear direction. The cover portion 47 serves as a cover portion that extends frontward from the drum accommodating portion 46, includes an upper portion that is open, and has a substantial "U" shape when seen in plan view.

An upper wall of the drum accommodating portion 46 is formed in a planar shape so that it is in substantially the same plane as the upper wall of the developer casing 31. Also, a bottom wall of the drum accommodating portion 46 is formed in an arc, when seen in side view, along the outer peripheral surface of the photosensitive drum 44. Abutment portions 48 that project downward are respectively disposed at the front end portion and the rear end portion of the bottom wall. The abutment portions 48 are formed at both width-direction end portions of the drum accommodating portion 46. In other words, four abutment portions 48 are disposed on the bottom wall of the drum accommodating portion 46.

The cover portion 47 includes side plates 49 and a bottom plate 50 that are integrally formed. The side plates 49 are continuous from lower portions of both side walls of the drum accommodating portion 46, face each other, and have substantially triangular shapes. The bottom plate 50 joins lower end portions of the side plates 49.

The drum-side guide grooves 51, which serve as first guide portions that are recessed rearward in substantial long and thin "U" shapes, are formed in the side plates 49 midway in the vertical direction. Lock grooves 52, which serve as notch-like engagement portions that are recessed downward, are formed in the drum-side guide grooves 51 midway in the front-rear direction. Also, drum-side guide protrusions 53, which slidably engage with later-described mainframe-side third guide grooves 65 (see FIG. 5) of the mainframe casing 2, project from both width-direction outer sides of lower front end portions of the side plates 49.

Also, the boss portion 61, which slidably engages with the guide groove 29 (see FIG. 3) of the scanner-side guide portion 28 of the scanner unit 17, is formed at a substantial width-direction central portion midway in the front-rear direction of the bottom plate 50 so as to project downward. Also, abutment portions 48 that project downward are disposed at the front end portion of the bottom plate 50. The abutment portions 48 are formed at both width-direction end portions of the bottom wall of the cover portion 47. In other words, two abutment portions 48 are disposed on the bottom plate 50.

It should be noted that play end portions of the abutment portions 48 formed in the drum casing 43 are formed so that they are in substantially the same plane in a substantially horizontal direction, and that the boss portion 61 is formed so as to be smaller than the abutment portions 48.

The photosensitive drum 44 comprises a cylindrical tube made of a metal such as aluminium, and the surface thereof is covered with a photosensitive layer comprising an organic photosensitive material whose main component is polycarbonate. The photosensitive drum 44 is supported, at both side walls of the drum accommodating portion 46 via a rotating shaft 63, so as to rotate in the same direction as the conveyor 56 at a nip portion where it faces and contacts the conveyor belt 56 and in a clockwise direction.

It should be noted that the rotating shaft 63 is disposed so as to project further outward in the width direction from both side walls of the drum accommodating portion 46, so that the rotating shaft 63 slidable engages with later-described mainframe-side second guide grooves 64.

Also, the scorotron charger 45 is fixed to the top wall of the drum accommodating portion 46 at a predetermined interval away from and above the photosensitive drum 44. The scorotron charger 45 is a positive charge-use scorotron charger that causes a charge-use wire such as tungsten to generate a corona discharge. The scorotron charger 45 is disposed so that the surface of the photosensitive drum 44 can be uniformly positively charged by the application of a voltage from an unillustrated power source.

When the photosensitive drum 44 rotates, first, the surface of the photosensitive drum 44 is uniformly positively charged by the scorotron charger 45. Thereafter, the surface of the photosensitive drum 44 is scanned at a high speed with a laser beam from the scanner unit 17 in accompaniment with the rotation of the photosensitive drum 44, whereby an electrostatic latent image based on image data is formed. Thereafter, when the photosensitive drum 44 faces the developer roller 34, the toner that is carried on the developer roller 34 and positively charged electrically moves to and is carried on the electrostatic latent image formed on the surface of the photosensitive drum 44 (i.e., the portion of the surface of the uniformly positively charged photosensitive drum 44 that has been exposed and whose electric potential has been lowered by the laser beam), whereby the image is visualized and reverse development is achieved. Thus, toner images of the respective colors are formed on the photosensitive drums 44.

Also, the photosensitive drum units 19 are disposed in line in a substantially vertical direction. In a state where the developing units 18 have been attached, the photosensitive drums 44 are disposed so that they face and contact, in a substantially horizontal direction, the developer rollers 34 of the developing units 18.

As shown in FIG. 1, the transfer unit 15 is disposed, at the side of the photosensitive drums 44 disposed in a substantially vertical direction opposite from the developing units 18, inside the mainframe casing 2 facing the photosensitive drums 44. The transfer unit 15 is disposed with a transfer drive roller 54, a transfer driven roller 55, a conveyor belt 56 comprising an endless belt, and transfer rollers 57.

The transfer drive roller 54 is disposed to the side and rear of the paper supply roller 12 and lower than the photosensitive drum 44 of the yellow process unit 14Y. The transfer driven roller 55 is disposed at a diagonally lower rear side of the fixing unit 16 and higher than the photosensitive drum 44 of the black process unit 14K.

The conveyor belt 56 comprises a conductive resin such as polycarbonate or polyimide in which conductive particles such as carbon are dispersed, and is wound around the transfer drive roller 54 and the transfer driven roller 55. The conveyor belt 56 is disposed so that the wound outer contact surface thereof faces and contacts all of the photosensitive drums 44 of the process units 14.

Due to the drive of the transfer drive roller 54, the transfer driven roller 55 is driven and the conveyor belt 56 moves in a counter-clockwise direction around the transfer drive roller 54 and the transfer driven roller 55 so that the contact surface of the conveyor belt 56 that faces and contacts the photosensitive drums 44 of the process units 14 moves in the same direction as the photosensitive drums 44.

The transfer rollers 57 are respectively disposed inside the wound conveyor belt 56 so as to face, in a substantially horizontal direction, the photosensitive drums 44 of the process units 14, with the conveyor belt 56 being sandwiched between the transfer rollers 57 and the photosensitive drums 44. Each transfer roller 57 is formed by a metal roller shaft covered with a conductive elastic member such as a rubber material. The transfer rollers 57 are disposed so as to be rotatable in a counter-clockwise direction and so that the contact surfaces thereof that face and contact the conveyor belt 56 move in the same direction as the circling movement direction of the conveyor belt 56. A transfer bias is applied to the transfer rollers 57 from an unillustrated power source at the time of transfer.

Also, the transfer unit 15 is integrally supported at the rear cover 8 of the mainframe casing 2. For this reason, when the rear cover 8 is opened as represented by the hypothetical line, the transfer unit 15 pivots around the transfer drive roller 54 and integrally moves with the open rear cover 8. When the rear cover 8 is closed, the transfer unit 15 pivots around the transfer drive roller 54 so that the conveyor belt 56 is pressed against the photosensitive drums 44.

The sheets of paper 3 supplied from the paper supply section 4 are successively guided upward by the guidance of the conveyance roller 13 and passed between the conveyor belt 56, which is moved by the driving movement of the transfer drive roller 54 and the driven movement of the transfer driven roller 55, and the photosensitive drum 44 of each process unit 14. As the paper 3 is being passed, toner images of the respective colors formed on the photosensitive drums 44 of the process units 14 are successively transferred to the paper 3, whereby a color image is formed on the paper 3.

That is, when the yellow toner image formed on the photosensitive drum 44 of the yellow process unit 14Y is transferred to the paper 3, the magenta toner image formed on the photosensitive drum 44 of the magenta process unit 14M is next superposed on and transferred to the paper 3 to which the yellow toner image has already been transferred. Similarly, the cyan toner image formed by the cyan process unit 14C and the black toner image formed by the black process unit 14K are superposed on and transferred to the paper 3, whereby a color image is formed on the paper 3.

Because the color laser printer 1 has the configuration of a tandem device disposed with a photosensitive drum 44 for each color, toner images of the respective colors are formed during this color image formation at substantially the same speed as the speed at which a monochrome image is formed, so that rapid color image formation can be achieved.

The fixing unit 16 is disposed above the process units 14 and the transfer unit 15, downstream in the conveyance direction of the paper 3. The fixing unit 16 is disposed with a heating roller 58 and a pressing roller 59. The heating roller 58 comprises a metal tube including a release layer formed on the surface thereof, with a halogen lamp being disposed inside along the axial direction. The surface of the heating roller 58 is heated to a fixing temperature by the halogen lamp. The pressing roller 59 is disposed so as to press the heating roller 58.

The color image transferred onto the paper 3 is then heat-fixed by the fixing unit 16 as the paper 3 passes between the heating roller 58 and the pressing roller 59.

The paper discharge section 6 is disposed with the paper discharge port 9 and the paper discharge tray 10. The sheets of heat-fixed paper 3 are discharged outside of the mainframe casing 2 through the paper discharge port 9 and stacked on the paper discharge tray 10.

Also, the color laser printer 1 is configured so that residual toner is recovered by a so-called cleaner-less development system where residual toner remaining on the photosensitive drums 44 after transfer is recovered by the developer rollers 34 in the process units 14. That is, in a cleaner-less development system, the surfaces of the photosensitive drums 44 including residual toner are charged, by the rotation of the photosensitive drums 44, at charging positions facing the scorotron chargers 45 and are then exposed by the scanner units 17. Residual toner at unexposed portions is electrically recovered by the developer rollers 34 when the surfaces of the photosensitive drums 44 face the developer rollers 34. Additionally, the toner images are formed at the exposed portions by the residual toner and the toners from the developer rollers 34. According to this cleaner-less development system, waste toner reservoirs for recovering and accommodating the residual toner become unnecessary. For this reason, space for disposing waste toner reservoirs becomes unnecessary and the developing units 18 and the photosensitive drum units 19 can be made compact. Thus, the developing units 18 and the photosensitive drum units 19 can be loaded and unloaded from the side opposite to the transfer side. Moreover, the developing units 18 and the scanner units 17 can be disposed in line in a substantially vertical direction, so that the area for disposing the color laser printer 1 can be reduced.

It should be noted that the developer rollers 34 in the present embodiment rotate at a peripheral velocity that is 1.6 times that of the photosensitive drums 44. Due to this difference in peripheral velocity, it becomes easy for the developer rollers 34 to recover the residual toner from the photosensitive drums 44.

Figure 5:
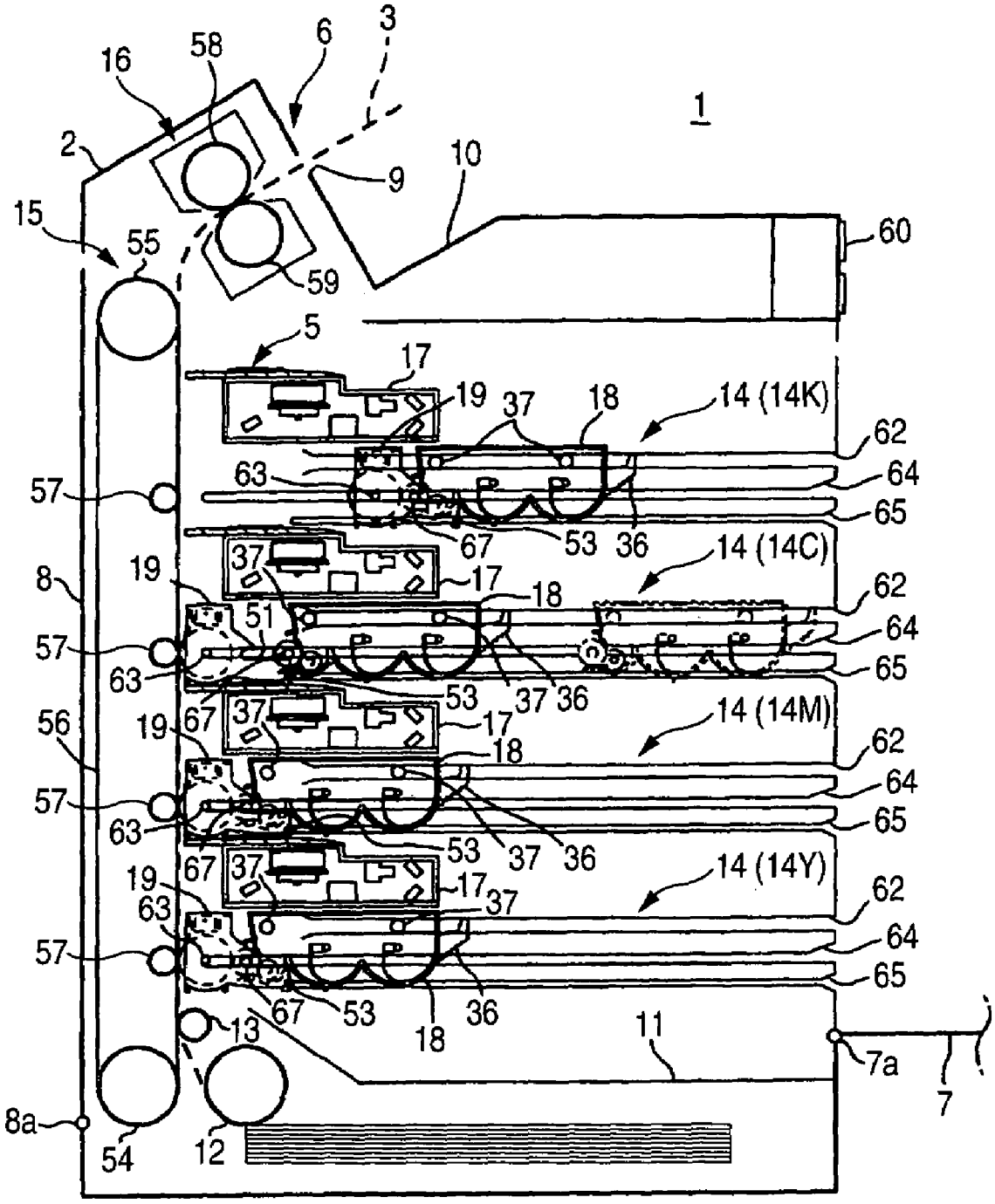
FIG. 5 is a sectional side view of the color laser printer shown in FIG. 1 and shows a state where the photosensitive drum units and the developing units are loaded and unloaded with respect to the mainframe casing.

Also, in the color laser printer 1, side plates 66 (see FIG. 3) are disposed at both width-direction inner sides of the mainframe casing 2. As shown in FIG. 5, mainframe-side first guide grooves 62, which serve as second guide portions with which the developer-side guide protrusions 37 of the developer casings 31 slidably engage, and mainframe-side second guide grooves 64 and mainframe-side third guide grooves 65, which serve as third guide portions with which the rotating shafts 63 of the photosensitive drums 44 and the drum-side guide protrusions 53 of the drum casings 43 slidably engage, are formed in the side plates 66 in correspondence to the process units 14.

The mainframe-side first guide grooves 62 are formed in an opposing manner in the side plates 66 so that the developer casings 31 are disposed in parallel to and at a predetermined interval below the scanner casings 20. Front end portions of the mainframe-side first guide grooves 62 open frontward when the front cover 7 is open. Rear end portions of the mainframe-side first guide grooves 62 are formed so as to open rearward at positions where the rear developer-side guide protrusions 37 of the developer casings 31 are disposed when the roller shafts 67 of the developer rollers 34 are disposed at the front end open portions (e.g., guide start positions) of the drum-side guide grooves 51 of the drum casings 43, so that a space between the front end portions and the rear end portions is formed in a substantially horizontal direction.

The mainframe-side second guide grooves 64 are formed in an opposing manner in the side plates 66 so that they are disposed in parallel to and at a predetermined interval below the mainframe-side first guide grooves 62 (see FIG. 3). Front end portions of the mainframe-side second guide grooves 64 are formed so as to open frontward when the front cover 7 is open. Rear end portions of the mainframe-side second guide grooves 64 are formed in substantial "U" shapes, when seen in side view, at positions where the rotating shafts 63 of the photosensitive drums 44 hit them when the photosensitive drums are disposed so as to face and contact the conveyor belt 44, so that so that a space between the front end portions and the rear end portions is formed in a substantially horizontal direction.

The mainframe-side third guide grooves 65 are formed in an opposing manner the side plates 66 so that the developer casings 31 are disposed in parallel, and with a predetermined interval disposed therebetween, below the mainframe-side second guide grooves 64. Front end portions of the mainframe-side third guide grooves 65 are formed so as to open frontward when the front cover 7 is open. Rear end portions of the mainframe-side third guide grooves 65 are formed in substantial "U" shapes, when seen in plan view, so that the drum-side guide protrusions 53 of the drum casings 43 do not hit them when the rotating shafts 63 of the photosensitive drums 44 hit the rear end portions of the mainframe-side second guide grooves 64, so that a space between the front end portions and the rear end portions is formed in a substantially horizontal direction.

In the color laser printer 1, the developing units 18 are attachable to and detachable from the photosensitive drum units 19, so that the developing units 18 and the photosensitive drum units 19 can be integrally loaded in and unloaded from the mainframe casing 2. The developing units 18 can also be attached to and detached from the photosensitive drum units 19 in a state where the photosensitive drum units 19 have been loaded in the mainframe casing 2.

Figure 4B:
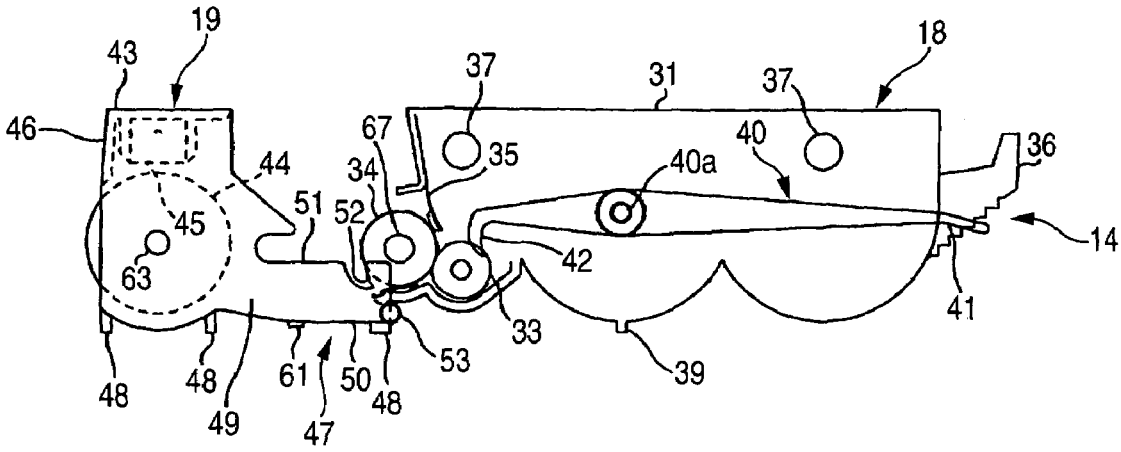

That is, the attachment and detachment of the developing units 18 with respect to the photosensitive drum units 19 are carried out as shown in FIGS. 4A and 4B. When the developing unit 18 is to be attached to the photosensitive drum unit 19 in a state where it is removed from the mainframe casing 2, first, the operational portion 41 of the engagement lever 40 is pushed downward counter to the urging force of the aforementioned spring to rotate the engagement lever 40 and position the pawl portion 42 upward from a state where the developer casing 31 is separated from the drum casing 43 as shown in FIG. 4B. Thereafter, the developing unit 18 is inserted rearward, whereby the roller shaft 67 of the developer roller 34 is inserted in the drum-side guide grooves 51 and the roller shaft 67 is inserted as far as the vicinity of the rear end portions of the drum-side guide grooves 51 as shown in FIG. 4A. In doing so, the pawl portion 42 of the engagement lever 40 engages with the inside of the lock grooves 52, whereby the developer roller 34 faces and contacts the photosensitive drum 44, and the developing unit 18 is attached to the photosensitive drum unit 19.

It should be noted that, in a state where the lock groove 52 is engaged with the pawl portion 42, the developing unit 18 is configured to be able to move slightly (e.g., about 1 mm) with respect to the photosensitive drum unit 19 in the front-rear direction. Specifically, the pawl portion 42 is formed in a size so that it can move about 1 mm in the front-rear direction. Moreover, the drum-side guide grooves 51 are formed so that the roller shaft 67 does not abut against the rear end portions of the drum-side guide grooves 51.

When the developing unit 18 is to be separated from the photosensitive drum unit 19 in a state where it is removed from the mainframe casing 2, first, the operational portion 41 of the engagement lever 40 is pushed downward counter to the urging force of the aforementioned spring to rotate the engagement lever 40 and release the engagement of the pawl portion 42 with respect to the lock groove 52 from a state where the developer casing 31 is attached to the drum casing 43 shown in FIG. 4A. Thereafter, the developing unit 18 is pulled frontward, whereby the roller shaft 67 of the developer roller 34 is retracted frontward from the drum-side guide grooves 51 of the drum casing 43 as shown in FIG. 4B. In doing so, the roller shaft 67 of the developer roller 34 is pulled out from the drum-side guide grooves 51 of the drum casing 43, whereby the developing unit 18 is separated from the photosensitive drum 19 in a state where the developing unit 18 has been removed from the mainframe casing 2.

By attaching and detaching the developing unit 18 in this manner, the developing unit 18 can be attached to and detached from the photosensitive drum unit 19 by the engagement between the pawl portion 42 disposed at the developer casing 31 and the lock groove 52 disposed in the drum casing 43.

During this attachment and detachment, the engagement and disengagement between the pawl portion 42 and the lock groove 52 can be operated with respect to the operational portion 41 of the engagement lever 40 of the developer casing 31. That is, the engagement and disengagement operations of the developing unit 18 with respect to the photosensitive drum unit 19 can be operated from the front side. For this reason, the ease and operability of the engagement and disengagement can be improved.

The integral loading and unloading of the developing unit 18 and the photosensitive drum unit 19 with respect to the mainframe casing 2 will be described with reference to, for example, the black process unit 14K in FIG. 5. In a case where, for example, the developing unit 18 and the photosensitive drum unit 19 are to be integrally loaded in the mainframe casing 2, first, the front cover 7 is opened, the grip portion 36 is gripped and the mutually attached photosensitive drum unit 19 and the developing unit 18 are slid rearward until the rotating shaft 63 of the photosensitive drum 44 hits the rear end portions of the mainframe-side second guide grooves 64 in a state where the developer-side guide protrusions 37 of the developer casing 31 engage with the mainframe-side first guide grooves 62, the rotating shaft 63 of the photosensitive drum 44 engages with the mainframe-side second guide grooves 64 and the drum-side guide protrusion 53 of the drum casing 43 engages with the mainframe-side third guide grooves 65.

In doing so, the developer-side guide protrusions 37 of the developer casing 31, the rotating shaft 63 of the photosensitive drum 44 and the drum-side guide protrusion 53 of the drum casing 43 are respectively guided rearward in a substantially horizontal direction by the mainframe-side first guide grooves 62, the mainframe-side second guide grooves 64 and the mainframe-side third guide grooves 65. When the drum casing 43 faces the scanner-side guide portion 28 disposed at the scanner casing 20, the drum casing 43 is guided by the scanner-side guide portion 28. Next, when the boss portion 61 of the cover portion 47 of the drum casing 43 faces the scanner-side guide portion 28 disposed in the scanner casing 20, the boss portion 61 engages with the lock groove 29 of the scanner-side guide portion 28, whereby the boss portion 61 is guided in the lock groove 52 (see FIG. 2B). Thereafter, the rotating shaft 63 of the photosensitive drum 44 hits the rear end portions of the mainframe-side second guide grooves 64, the photosensitive drum 44 faces and contacts the conveyor belt 56, and the developing unit 18 and the photosensitive drum unit 19 are integrally loaded in the mainframe casing 2.

Figure 6:
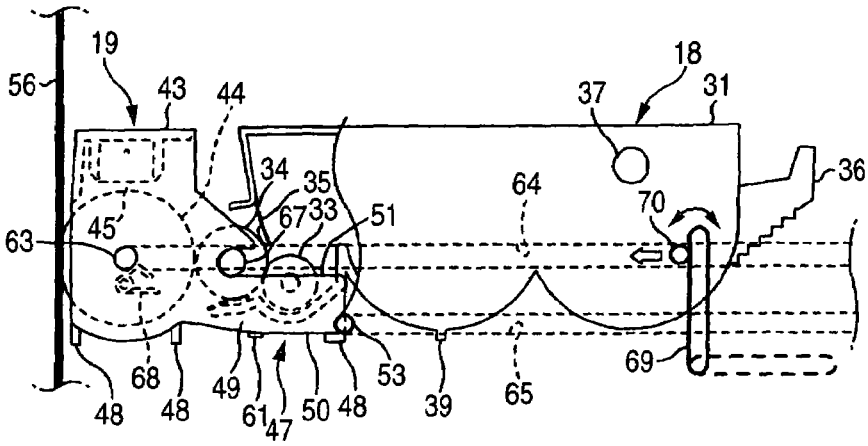
FIG. 6 is an enlarged sectional side view of the color laser printer shown in FIG. 1 and shows a state where the photosensitive drum unit and the developing unit are loaded in and unloaded from the mainframe casing.

It should be noted that, in a state where the developing unit 18 and the photosensitive drum unit 19 have been loaded in the mainframe casing 2 in this manner, the rotating shaft 63 crosses over the upper portion of a press spring 68 (only shown in FIG. 6) disposed in the mainframe casing 2 just before the rotating shaft 63 of the photosensitive drum 44 hits the rear end portions of the mainframe-side second guide grooves 64, as shown in FIG. 6. Also, because the press spring 68 presses the rotating shaft 63 rearward in a state where the rotating shaft 63 of the photosensitive drum 44 hits the rear end portions of the mainframe-side second guide grooves 64, the photosensitive drum 44 can be positioned so that it contacts the conveyor belt 56. Also, a push lever 69 (only shown in FIG. 6) is disposed in the mainframe casing 2 so that it can push an abutment shaft 70 (only shown in FIG. 6), which is formed so as to project from both width-direction sides of the rear portion of the developer casing 31, rearward.

The push lever 69 is moved, by the drive of an unillustrated motor, between a retracted position represented by the hypothetical line and a pushing position represented by the solid line. When the photosensitive drum 44 rotates, the push lever 69 is moved to the pushing position, and when the rotation of the photosensitive drum 44 stops, the push lever 69 is moved to the retracted position. Thus, the developer roller 34 can be positioned so that it reliably contacts the photosensitive drum 44.

It should be noted that the push lever 69 may also be configured to move in association with the opening and closing of the front cover 7 rather than using the motor.

In this loaded state, as shown in FIG. 1, the grip portions 36 are disposed so as to project frontward from the scanner units 17 in a substantially vertical direction, and spaces are disposed above the grip portions 36.

When the photosensitive drum unit 19 and the developing unit 18 are to be integrally separated from the mainframe casing 2, first, the front cover 7 is opened, the grip portion 36 is gripped and the photosensitive drum unit 19 and the developing unit 18, which are in an attached state, are slid forward.

In doing so, the rotating shaft 63 of the photosensitive drum 44 crosses over the upper portion of the push spring 68 counter to the pushing force of the push spring 68 and moves forward, and the boss portion 61 is guided in a substantially horizontal direction by the lock groove 29 of the scanner-side guide portion 28. Also, the developer-side guide protrusions 37 of the developer casing 31, the rotating shaft 63 of the photosensitive drum 44 and the drum-side guide protrusion 53 of the drum casing 43 are respectively guided forward in a substantially horizontal direction by the mainframe-side first guide grooves 62, the mainframe-side second guide grooves 64 and the mainframe-side third guide grooves 65. The photosensitive drum unit 19 and the developing unit 18, which are in a mutually attached state, are pulled out as one unit from the mainframe casing 2, whereby the photosensitive drum unit 19 and the developing unit 18 are integrally separated from the mainframe casing 2.

The attachment and detachment of the developing unit 18 with respect to the photosensitive drum unit 19 in a state where the photosensitive drum 19 is already loaded in the mainframe casing 2 will be described with reference to, for example, the cyan process unit 14C in FIG. 5. As described above, in a state where the mutually attached photosensitive drum unit 19 and the developing unit 18 have been loaded in the mainframe casing 2, first, the front cover 7 is opened, the operational portion 41 of the engagement lever 40 of the developer casing 31 is pushed downward and the engagement of the pawl portion 42 with respect to the lock groove 52 is released as shown in FIG. 4A. Thereafter, the grip portion 36 is gripped and the developing unit is slid forward.

In doing so, the attachment of the developing unit 18 with respect to the photosensitive drum unit 19 is released, the roller shaft 67 of the developer roller 34 is pulled out from the drum-side guide grooves 51 of the drum casing 43 and the developing unit 18 is separated from the photosensitive drum unit 19 as shown in FIG. 5. Next, the developer-side guide protrusions 37 of the developer casing 31 are guided in a substantially horizontal direction by the mainframe-side first guide grooves 62, and the developing unit 18 is pulled out from the mainframe casing 2. Thus, only the developing unit 18 is separated from the mainframe casing 2.

When the developing unit 18 is to be attached to the photosensitive drum unit 19 in a state where the photosensitive drum unit 19 is loaded in the mainframe casing 2, first, the front cover 7 is opened, the grip portion 36 is gripped and the developing unit 18 is slid rearward in a state where the developer-side guide protrusions 37 are engaged with the mainframe-side first guide grooves 62.

In doing so, the developer-side guide protrusions 37 of the developer casing 37 are guided rearward in a substantially horizontal direction by the mainframe-side first guide grooves 62. When the developer-side guide protrusions 37 are guided as far as the rear end portions of the mainframe-side first guide grooves 62, the roller shaft 67 of the developer roller 34 engages with the drum-side guide grooves 51 of the drum casing 43 at that position as shown in FIG. 4B. Next, the roller shaft 67 is guided to the drum-side guide grooves 51, whereby the guidance of the developer casing 31 is transferred from the mainframe casing 2 to the drum casing 43.

Thereafter, as shown in FIG. 4A, the pawl portion 42 positioned above the aforementioned spring abuts against the front end portions of the side plates 49 of the drum casing 43 where the roller shaft 67 is at a position in front of the rear end portions of the drum-side guide grooves 51. Thereafter, the operational portion 41 rotates downward, the pawl portion 42 of the engagement lever 40 moves upward and the developing unit 18 is slid rearward. When the operator releases the operational portion 41 when the roller shaft 67 is at a position that becomes the rear end position of the drum-side guide grooves 51, the pawl portion 42 engages with the inside of the lock groove 52 of the drum casing 43 due to the urging force of the spring. Thus, the developer roller 34 faces and contacts the photosensitive drum 44 and the developing unit 18 is attached to the photosensitive drum unit 19.

In the color laser printer 1, the developing unit 18 and the photosensitive drum unit 19 can be loaded in and unloaded from the mainframe casing 2 in this manner as one unit. Also, the developing unit 18 can be attached to and detached from the photosensitive drum unit 19 in a state where the photosensitive drum unit 19 is already loaded in the mainframe casing 2.

For this reason, when the toner hopper runs out of toner, it is possible to replace only the developing unit 18, whose replacement frequency is high, by separating the used developing unit 18 from the photosensitive drum unit 19 in a state where the photosensitive drum unit 19 is already loaded in the mainframe casing 2 and then attaching a new developing unit 18 to the photosensitive drum unit 19. As a result, running costs can be reduced and industrial waste can be reduced even more than replacing the photosensitive drum unit 19 and the developing unit 18 as one unit. Moreover, the replacement of the developing unit 18 is facilitated.

Also, in the tandem color laser printer 1 disposed with a photosensitive drum 44 for each color, the respective colors are successively transferred by the photosensitive drums 44. Thus, positional precision is required of the photosensitive drums 44 in order to prevent intercolor color shifting. For this reason, the photosensitive drums 44 should not be unnecessarily loaded and unloaded.

By replacing the developing unit 18 with respect to the photosensitive drum unit 19 in a state where the photosensitive drum unit 19 is already loaded in the mainframe casing 2, it is possible to replace only the developing unit 18 without unloading and loading the photosensitive drum 44. For this reason, positional displacement of the photosensitive drums 44 can be prevented and high-quality color images in which there is little color shifting can be formed.

Also, when the photosensitive drum 44 is to be replaced, the developing unit 18 and the photosensitive drum unit 19 are unloaded as one unit from the mainframe casing 2 as described above, the developing unit 18 is thereafter detached from the used photosensitive drum unit 19, the developing unit 18 is next attached to a new photosensitive drum unit 19 and these are loaded as one unit in the mainframe casing 2, whereby the photosensitive drum unit 19, whose replacement frequency is low, can be replaced.

Also, in the color laser printer 1, because the developing unit 18 and the photosensitive drum unit 19 are loaded and unloaded at the side of the photosensitive drum 44 opposite from the position of transfer to the paper 3, interference with the transfer unit 15 can be avoided. For this reason, the loading and unloading of the developing unit 18 and the photosensitive drum unit 19 can be secured.

Also, during the loading and unloading operations, the grip portion 36 disposed at the developing unit 18 is gripped so that just the developing unit 18 or both the developing unit 18 and the photosensitive drum unit 19 can be loaded in and unloaded from the mainframe casing 2. For this reason, operability can be improved.

Also, in the color laser printer 1, because the developing units 18 and the photosensitive drum units 19 are alternatingly disposed, just the developing units 18 or both of the developing units 18 and the photosensitive drum units 19 can be loaded in and unloaded from between the scanner units 17.

Moreover, in the color laser printer 1, because the developing units 18 and the scanner units 17 are disposed so as to alternate in a substantially vertical direction, the space of the area in which the printer is disposed can be economized.

Also, because the developer-side guide protrusions 37 of the developer casing 31 are guided in a substantially horizontal direction by the mainframe-side first guide grooves 62 during the loading and unloading operations, the loading and unloading of the developing unit 18 with respect to the mainframe casing 2 can be secured. Also, because the rotating shaft 63 of the photosensitive drum 44 and the drum-side guide protrusion 53 of the drum casing 43 are respectively guided in a substantially horizontal direction by the mainframe-side second guide grooves 64 and the mainframe-side third guide grooves 65, the loading and unloading of the photosensitive drum unit 19 with respect to the mainframe casing 2 can be secured.

Also, because the mainframe-side first guide grooves 62, the mainframe-side second guide grooves 64 and the mainframe-side third guide grooves 65 are disposed along the longitudinal direction of the surface of the scanner casing 31 of the scanner unit 17, just the developing unit 18 or both of the developing unit 18 and the photosensitive drum unit 19 can be loaded in and unloaded from between the scanner units 17.

Moreover, because the mainframe-side first guide grooves 62, the mainframe-side second guide grooves 64 and the mainframe-side third guide grooves 65 are disposed in an opposing manner in the opposing side plates 66 at both width-direction sides (both sides in the axial direction of the developer rollers 34) of the developing units 18, the loading and unloading of the developing units 18 and the photosensitive drum units 19 with respect to the mainframe casing 2 can be guided.

Moreover, because the developer-side guide protrusions 37 are respectively disposed in the vicinity of a position corresponding to the developer roller 34 and the vicinity of a position corresponding to the agitator 38 that is farthest from the developer roller 34, the developer-side guide protrusions 37 engage with the mainframe-side first guide grooves 62, whereby the developing unit 18 can be guided in a state where chattering in a substantially horizontal direction is prevented. For this reason, stable loading and unloading with respect to the mainframe casing 2 can be improved even if the developing units 18 are formed long in a substantially horizontal direction.

Also, because the grip portions 36 are disposed so as to project frontward from the scanner units 17 in a substantially vertical direction in a state where the developing units 18 are attached to the photosensitive drum units 19 that are loaded in the mainframe casing 2, so that spaces are disposed above the grip portions 36, the grip portions 36 can be easily gripped. For this reason, operability during loading and unloading can be improved.

Also, because the boss portion 61 of the cover portion 47 of the photosensitive drum unit 19 is guided by the lock groove 29 of the scanner-side guide portion 28 disposed in the scanner casing 20, more stable loading and unloading of the photosensitive drum unit 19 can be secured. Moreover, because the scanner-side guide portion 28 that guides the boss portion 61 is integrally formed with the scanner casing 20 (i.e., the surface of the scanner casing 20 doubles as a guide member of the developing unit 18), the number of parts can be reduced, the configuration of the apparatus can be simplified and the photosensitive drum unit 19 can be loaded and unloaded.

Also, in the color laser printer 1, the roller shaft 67 of the developer roller 34 is guided by the drum-side guide grooves 51 of the photosensitive drum unit 19 during attachment and detachment of the developing unit 18 with respect to the photosensitive drum unit 19, whereby the developer roller 34 is guided so as to face the photosensitive drum 44. For this reason, the positional precision of the developer roller 34 with respect to the photosensitive drum 44 is good. As a result, color image formation can be excellently achieved.

Moreover, in the color laser printer 1, in a case where the developing unit 18 is to be attached to the photosensitive drum unit 19 in a state where the photosensitive drum unit 19 is already loaded in the mainframe casing 2, first, the developer casing 31 is guided by the engagement between the mainframe-side first guide grooves 62 and the developer-side guide protrusions 37 as far as the guide starting position at which the roller shaft 67 of the developer roller 34 is guided by the drum-side guide grooves 51. Next, the engagement between the mainframe-side first guide grooves 62 and the developer-side guide protrusions 37 is released and the roller shaft 67 and drum-side guide grooves 51 engage, whereby the developer roller 34 is guided as far as a position where it faces and contacts the photosensitive drum 44. Thus, the developing roller 34 can be disposed with good positional precision with respect to the photosensitive drum 44 even if the photosensitive drum unit 19 is already loaded in the mainframe casing 2.

Also, in the color laser printer 1, as shown in FIG. 1, because the direction in which the paper supply tray 11 is removed, the display direction of the operation panel 60, the direction in which the paper 3 is discharged through the paper discharge port 9, and the direction in which the photosensitive drum unit 19 and the developing unit 18 are removed are substantially the same direction, the operator can access everything from substantially the same direction while operating these. For this reason, operability can be improved.

In particular, because the discharge direction of the paper 3 and the removal direction of the developing unit 18 are substantially the same direction, the operator can remove the discharged paper 3 and load and unload the developing unit 18 from the same direction. For this reason, operability can be further improved.

Figure 7:
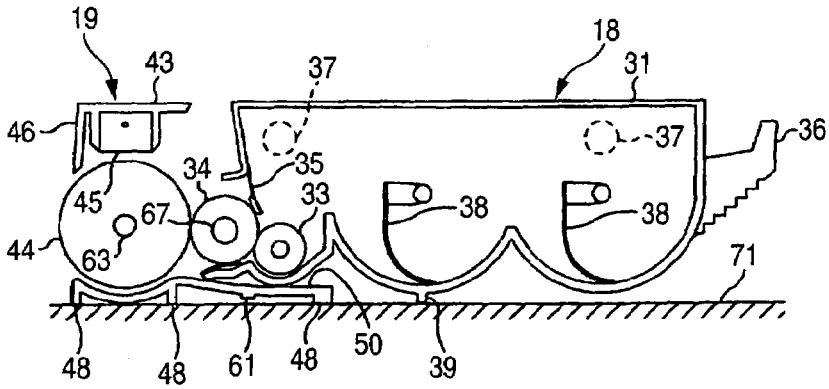
FIG. 7 is a sectional side view showing a state where the photosensitive drum unit and the developing unit of the color laser printer shown in FIG. 1 are placed on a placement surface in a state where the developing unit is attached with respect to the photosensitive drum unit.

Also, in the color laser printer 1, as shown in FIG. 7, the abutment portions 48 disposed in the bottom wall of the drum accommodating portion 46 of the drum casing 43 abut against a placement surface 71 in a state where the developing unit 18 and the photosensitive drum unit 19 have been removed from the mainframe casing 2, and the abutment portion 39 disposed in the bottom wall of the developer casing 31 abuts against the placement surface 71, whereby the developing unit 18 and the photosensitive drum unit 19 can be stably placed as one unit. For this reason, the developing unit 18 and the photosensitive drum unit 19 can be prevented from toppling over and the ease with which these can be replaced is improved.

Figure 8:
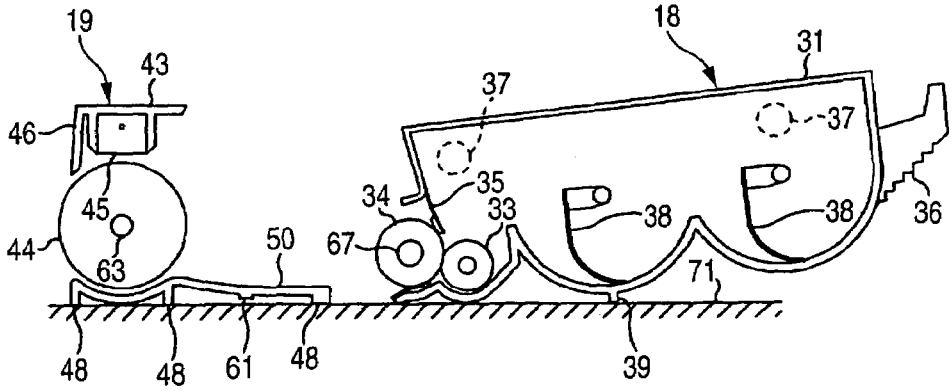
FIG. 8 is a sectional side view showing a state where the photosensitive drum unit and the developing unit of the color laser printer shown in FIG. 1 are placed on the placement surface in a state where the developing unit is separated with respect to the photosensitive drum unit.

Also, as shown in FIG. 8, the developing unit 18 and the photosensitive drum unit 19 can also be independently placed using the abutment portions 39 and 48 disposed at each. For this reason, it becomes easier to handle the developing unit 18 and the photosensitive drum unit 19.

Moreover, because the abutment portions 48 are also disposed in the bottom plate 50 of the cover portion 47 of the drum casing 43 in the photosensitive drum unit 19, part of the developing unit 18 is covered by the cover portion 47, and both of the developing unit 18 and the photosensitive drum unit 19 or just the photosensitive drum unit 19 can be prevented from toppling over by the abutment portions 48 disposed in the bottom plate 50 of the cover portion 47. For this reason, the number of parts can be reduced with a simple configuration, and both of the developing unit 18 and the photosensitive drum unit 19 or just the photosensitive drum unit 19 can be prevented from toppling over.

Figure 9:
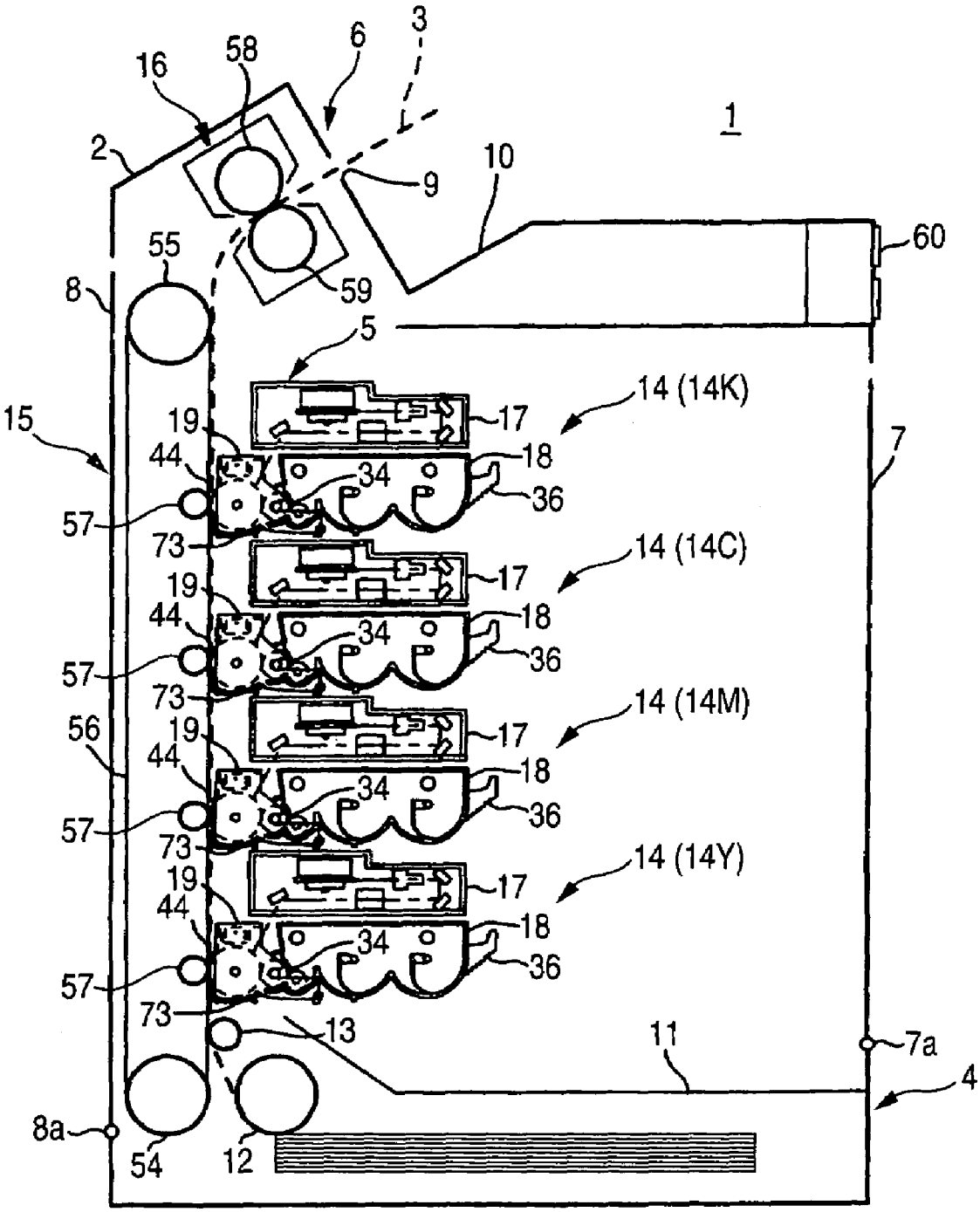
FIG. 9 is a sectional side view (in a state where a rear cover is closed) of an embodiment where a shutter mechanism is disposed in the color laser printer shown in FIG. 1.
Figure 10:
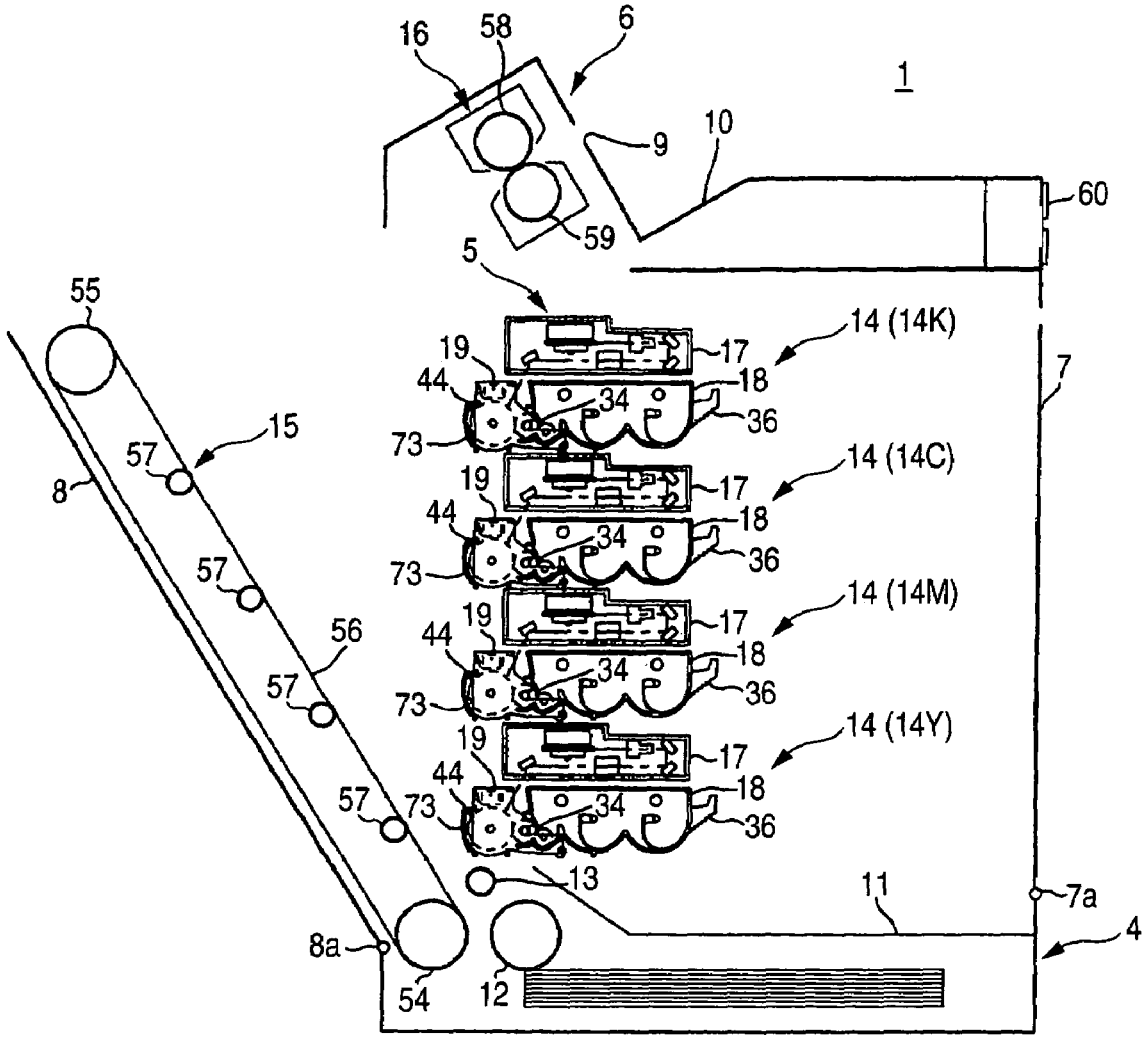
FIG. 10 is a sectional side view (in a state where the rear cover is open) of the embodiment where the shutter mechanism is disposed in the color laser printer shown in FIG. 1.

Also, in the color laser printer 1, as shown in FIGS. 9 and 10, a shutter mechanism 72 (see FIG. 11) that is openable and closeable by a shutter member 73 and covers the transfer position to the paper 3 of the photosensitive drum 44 can be disposed at each photosensitive drum 44.

Figure 11:
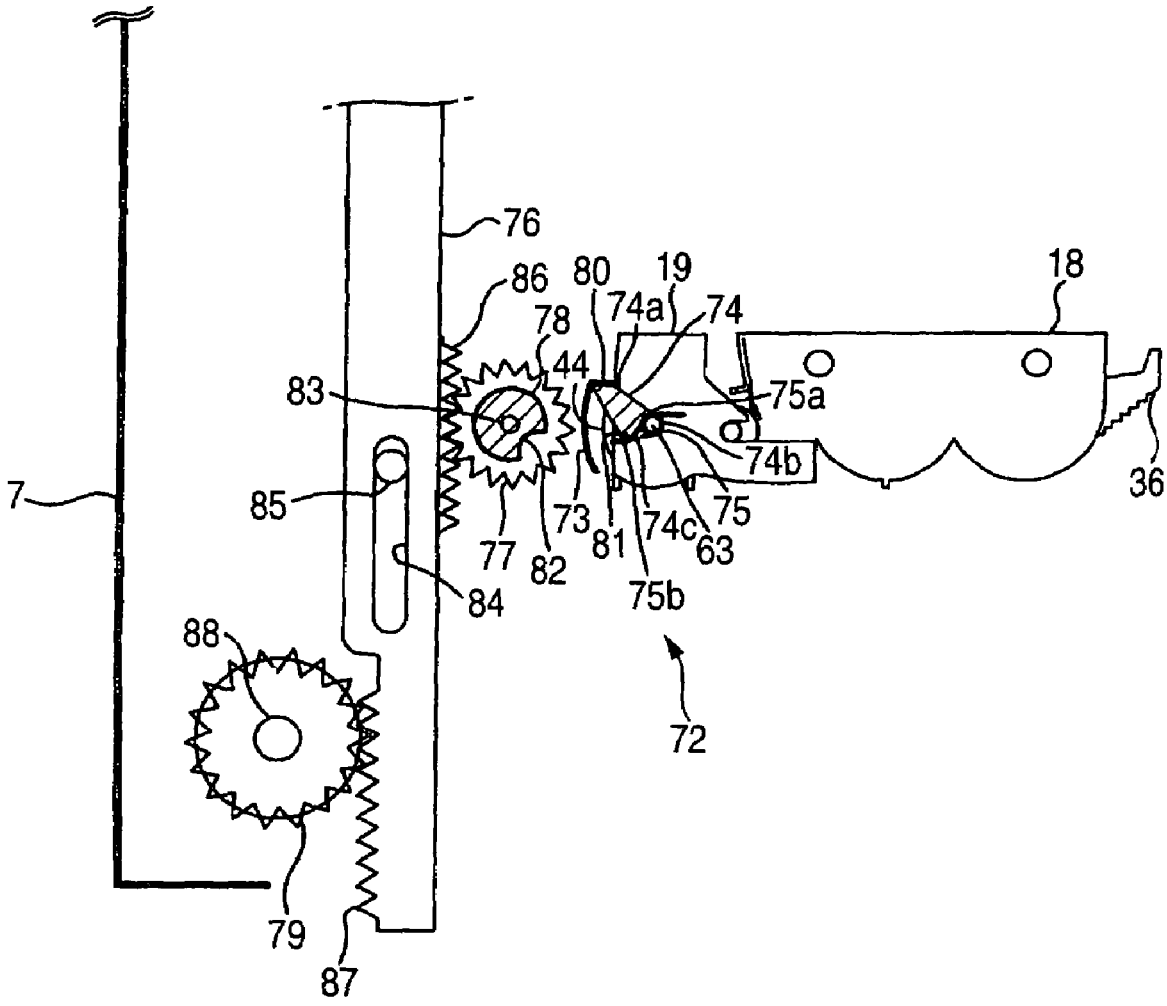
FIG. 11 is an enlarged sectional side view of the shutter mechanism of the color laser printer shown in FIG. 1 and shows a state where the photosensitive drum unit and the developing unit are separated with respect to the mainframe casing.

That is, as shown in FIG. 11, the shutter mechanism 72 includes: the shutter member 73, a swinging arm 74 serving as an engaged portion and an urging spring 75 serving as urging means, which are disposed at each photosensitive drum 44; a rack member 76 serving as shutter moving means, a mainframe-side pinion key 77 and a coupling cam 78 serving as an engagement portion, which are disposed at the mainframe casing 2; and an open/close-side pinion gear 79 disposed at the rear cover 8.

The shutter member 73 has a cross-sectionally substantially arc-like shape, can cover the photosensitive drum 44 along the axial direction, and is formed in a plate shape with a width that can be accommodated between both side walls of the drum casing 43. Coupling plates 80, with which the swinging arm 74 is coupled, are formed so as to project outward in the width direction from both width-direction sides of one side end portion (front end portion at a later-described exposure position) of the shutter member 73.

The swinging arm 74 is integrally disposed with the shutter member 73, has a substantially triangular plate-like shape where a leading end portion 74*a*, a base end portion 74*b* and another base end portion 74*c* of the swinging arm 74 are disposed in a substantially triangular shape, and is respectively disposed at outer sides of both side walls of the drum casing 43. A through hole through which the rotating shaft 63 of the photosensitive drum 44 is passed is formed in the base end portion 74*b* of the swinging arm 44. By passing the rotating shaft 63 through this through hole, the swinging arm 74 is supported so as to be pivotable around the rotating shaft 63. Also, a lock protrusion 81 with which the urging spring 75 locks projects outward in the width direction from the other base end portion 74*c* of the swinging arm 74. The lock protrusion 81 is formed so as to project further outward in the width direction than the rotating shaft 63. Also, the lock protrusion 81 is joined to the leading end portion 74*a* of the swinging arm 74 so as to be continuous with the coupling plates 80 of the shutter member 73.

The urging springs 75 comprise coil springs and are respectively disposed at outer sides of the swinging arm 74. Coil portions 75*a* formed in coils are inserted in the rotating shaft 63, with one of two play end portions 75*b* that linearly extend from both sides of the coil portion 75*a* being locked at the lock protrusion 81 of the swinging arm 74 and the other play end portion being supported at the drum casing 43.

Thus, as shown in FIG. 11, the lock protrusion 81 of the swinging arm 74 is always urged rearward by the urging springs 75, the swinging arm 74 rotates in a clockwise direction, and the shutter member 73 is positioned at the covering position where it covers the front of the photosensitive drum 44.

The mainframe-side pinion gear 77 and coupling cam 78 are disposed for each photosensitive drum unit 19 at both width-direction sides of the mainframe casing 2. The mainframe-side pinion gear 77 and coupling cam 78 are formed as one unit and are rotatably supported at the mainframe casing 2.

The coupling cam 78 has a substantial disc shape, with a substantially fan-shaped cutout portion 82 being formed therein. The cutout portion 82 is formed so as to be recessed rearward so as to abut against the lock protrusion 81 further outward from the axial end portions of the rotating shaft 63 in a state where the rear cover 8 is open.

Also, the mainframe-side pinion gear 77 is disposed so that relative rotation with the coupling cam 78 is impossible. A support shaft 83 that projects inward in the width direction from the mainframe casing 2 is passed through the center portion of the mainframe-side pinion gear 77 and coupling cam 78, whereby the mainframe-side pinion gear 77 and coupling cam 78 are supported so as to be rotatable around the support shaft 83.

The rack members 76 have plate shapes that extend in the vertical direction and are disposed at both width-direction sides of the mainframe casing 2 so as to face the mainframe-side pinion gears 77. Substantially long and thin oval slide grooves 84 are plurally disposed at predetermined intervals in the vertical direction in the rack members 76. Also, support pins 85 that slidably lock with the insides of the slide grooves 84 are disposed in the mainframe casing 2.

The rack members 76 are slidably supported in a substantially vertical direction with respect to the mainframe casing 2 in a state where the support pins 85 have been slidably received inside the slide grooves 84.

First racks 86 that mesh with the mainframe-side pinion gears 77 are respectively formed at positions facing the mainframe-side pinion gears 77 midway in the longitudinal direction on front surfaces of the rack members 76. Also, second racks 87 that mesh with transfer-side pinion gears 79 are respectively formed at positions facing the transfer-side pinion gears 79 at lower end portions of rear surfaces of the rack members 76.

The open/close-side pinion gears 79 are disposed so that relative rotation with rotating shafts 88 thereof is impossible and so as to face the second racks 87 of the rack members 76 at both end portions (in the axial direction of the rotating shafts 88) of the hinge 8*a* of the rear cover 8.

In the shutter mechanism 72, first, when the photosensitive drums 44 of the photosensitive drum units 19 are not positioned at the transfer positions, as shown in FIG. 11, the shutter members 73 are positioned, by the urging force of the urging springs 75, in the cover positions where they cover the front of the photosensitive drums 44, whereby damage to and deterioration of the surfaces of the photosensitive drums 44 are prevented.

Figure 12:
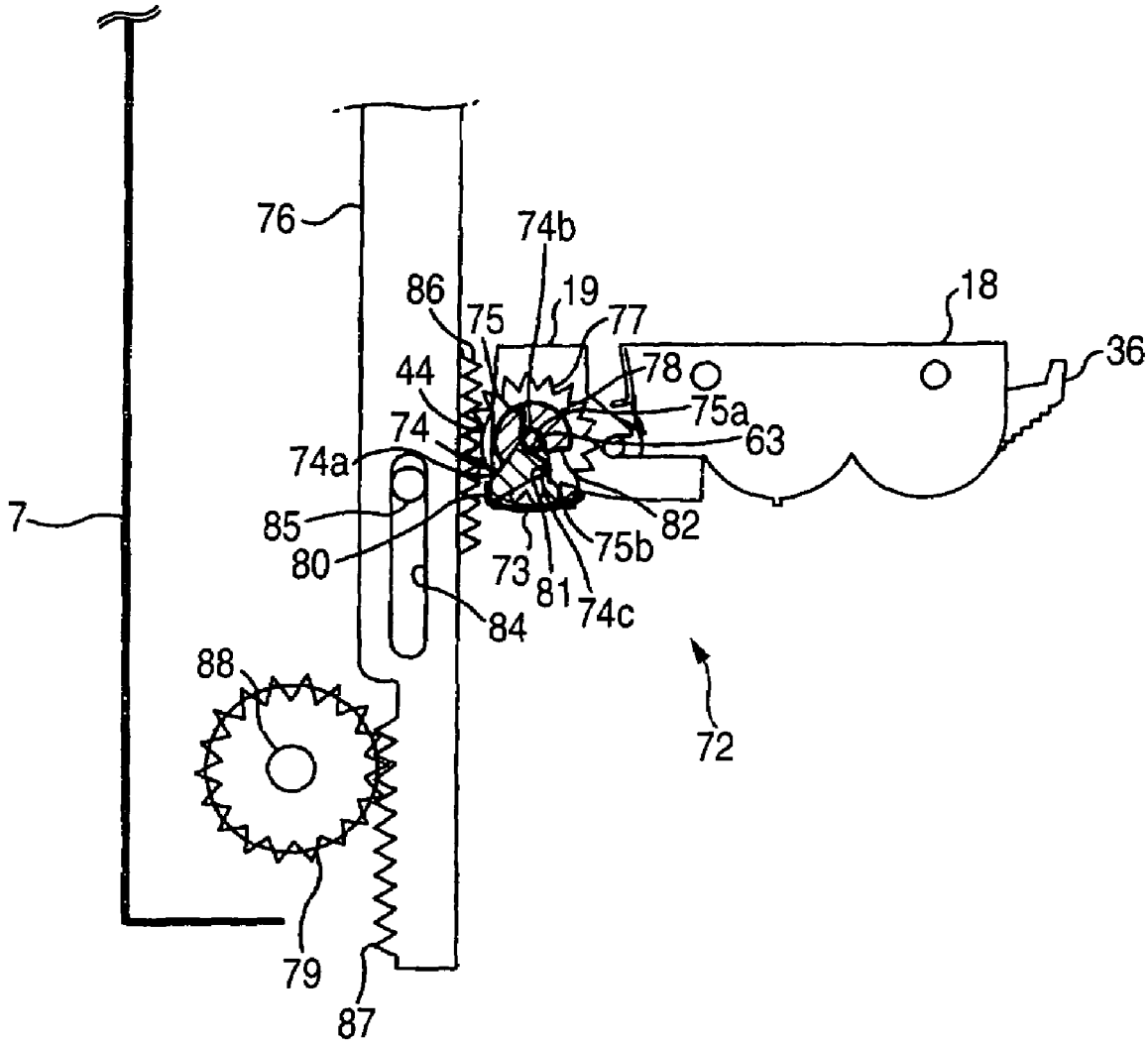
FIG. 12 is an enlarged sectional side view of the shutter mechanism of the color laser printer shown in FIG. 1 and shows a state where the rear cover is closed.

Next, as shown in FIG. 12, when the photosensitive drum unit 19 is slid rearward in order to load it in the mainframe casing 2 and the photosensitive drum 44 approaches the vicinity of the transfer position, the cutout portions 82 of the coupling cams 78 abut against the lock protrusions 81 of the swinging arms 74, and the lock protrusions 81 are pushed frontward in accompaniment with the rearward sliding of the photosensitive drum unit 19. In doing so, the swinging arms 74 pivot in a counter-clockwise direction counter to the urging force of the urging springs 75, whereby the shutter members 73 that had covered the photosensitive drum 44 at rear sides are swung frontward so as to go under the bottom wall of the drum casing 43 and be positioned at the exposure position below the bottom wall of the drum casing 43. As a result, the rear surface of the photosensitive drum 44 is exposed at the transfer position.

Figure 13:
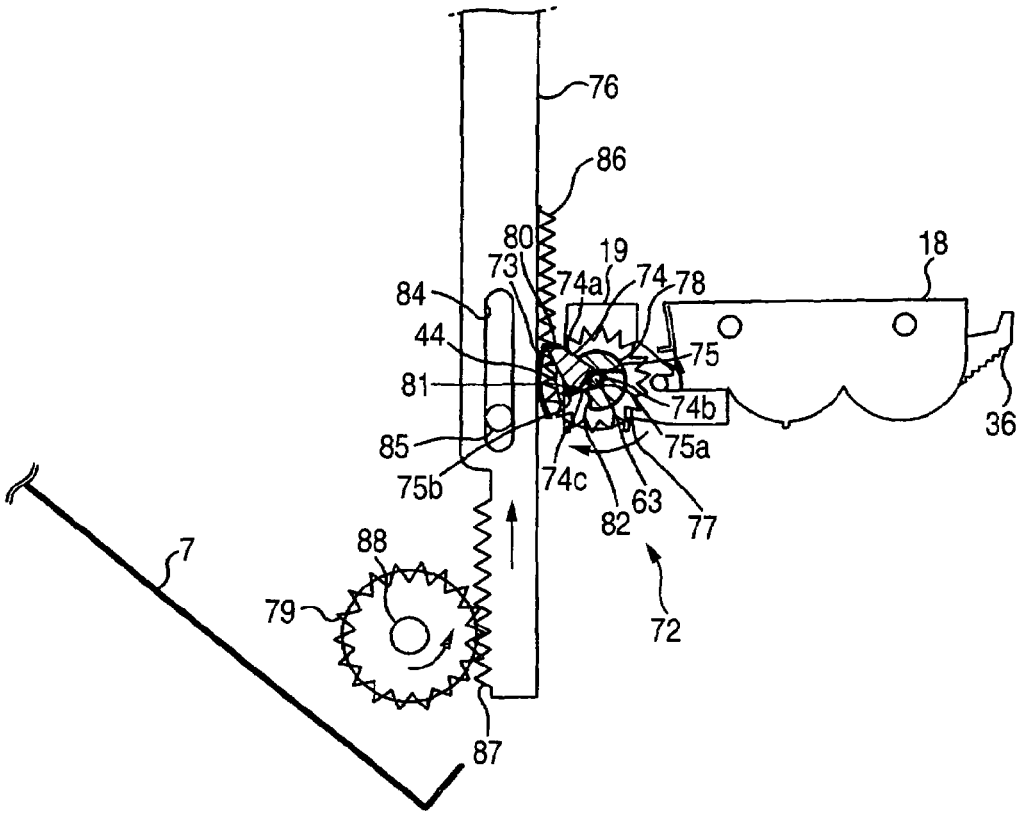
FIG. 13 is an enlarged sectional side view of the shutter mechanism of the color laser printer shown in FIG. 1 and shows a state where the rear cover is open.

Thereafter, when the rear cover 8 is opened as shown in FIG. 13, the open/close-side pinion gears 79 are rotated in the direction of the arrow (counter-clockwise direction) by the rotation of the rotating shafts 88 accompanying the opening movement. Thus, the rack members 76 are slid upward via the second racks 87 meshing with the open/close-side pinion gears 79. In doing so, because the mainframe-side pinion gears 77 meshing with the first racks 86 are rotated in the direction of the arrow (clockwise direction), the coupling cams 78 disposed so that relative rotation with the mainframe-side pinion gears 77 is impossible are similarly rotated in the direction of the arrow (clockwise direction). Thus, the shutter members 73 that had exposed the photosensitive drums 44 below the bottom walls of the drums casings 43 are swung rearward so as to cover the photosensitive drums 44 and be positioned at covering positions at the rear sides of the photosensitive drums 44. As a result, the rear surfaces of the photosensitive drums 44 are covered from the transfer positions.

It should be noted with respect to the shutter mechanism 72 that, by closing the rear cover 8, the open/close-side pinion gears 79 are rotated opposite to what was described above—i.e., in the clockwise direction due to the rotation of the rotating shafts 88 accompanying the closing movement. Thus, the rack members 76 are slid downward via the second racks 87 meshing with the open-close-side pinion gears 79. In doing so, because the mainframe-side pinion gears 77 meshing with the first racks 86 are rotated in the counter-clockwise direction, the coupling cams 78 disposed so that relative rotation with the mainframe-side pinion gears 77 is impossible are similarly rotated in the counter-clockwise direction. Thus, the shutter members 73 are moved from the covering positions to the exposure positions and, as a result, the rear surfaces of the photosensitive drums 44 are exposed at the transfer positions.

Next, when the photosensitive drum unit 19 is pulled out frontward in order to remove the photosensitive drum unit 19 from the mainframe casing 2, the photosensitive drum 44 is separated frontward from the transfer position, the abutment of the cutout portion 82 of the coupling cam 78 against the lock protrusion 81 of the swinging arm 74 is released, and the swinging arm 74 is moved in a clockwise direction by the urging force of the urging spring 75. Thus, the shutter member 73 is moved from the exposure position to the covering position so that damage to and deterioration of the surface of the photosensitive drum 44 are prevented.

By disposing the shutter mechanism 72, the photosensitive drums 44 can be exposed with respect to the transfer positions only when necessary by selectively moving the shutter members 73 to the covering positions or the exposure positions. Thus, damage to and deterioration of the photosensitive drums 44 can be prevented.

That is, in the shutter mechanism 72, the shutter members 73 are moved to the cover positions when the rear cover 8 is open. For this reason, the photosensitive drums 44 are prevented from being exposed in the space formed by the open state of the rear cover 8, and damage to and deterioration of the photosensitive drums 44 can be prevented. Additionally, the shutter members 73 are moved to the exposure positions when the rear cover 8 is closed. For this reason, the photosensitive drums 44 are made to face the conveyor belt 56 at the transfer positions so that the transfer operation can be conducted.

Also, in the shutter mechanism 72, the swinging arms 74 integrally disposed with the shutter members 73 engage with and disengage from the coupling cams 78 that rotate in association with the opening and closing of the rear cover 8 via the open/close-side pinion gears 79, the rack members 76 and the mainframe-side pinion gears 77. For this reason, the shutter members 73 can be moved to the cover positions and the exposure positions in association with the opening and closing of the rear cover 8.

It should be noted that, although the direct transfer type tandem color laser printer 1, where the toner images are directly transferred from the photosensitive drums 44 to the paper 3, was described above as an example, the present invention is not limited thereto. The invention may also be configured as an intermediate transfer type tandem color laser printer where the toner images of the respective colors are temporarily transferred from photosensitive bodies to a transfer medium and thereafter transferred at once to paper.

Also, with respect to the shutter mechanism 72 in the above description, although the coupling cams 78 were disposed in the mainframe casing 2 so that the coupling cams 78 and the opening and closing of the rear cover 8 were associated via the open/close-side pinion gears 79, the rack members 76 and the mainframe-side pinion gears 77, the invention may also be configured so that the coupling cams 78 are directly disposed in the rear cover 8 without disposing the open/close-side pinion gears 79, the rack members 76 and the mainframe-side pinion gears 77, and so that the shutter members 73 are selectively moved to the covering positions or the exposure positions by the engagement or disengagement between the coupling cams 78 and the lock protrusions 81 of the swinging arms 74.

Figure 14:
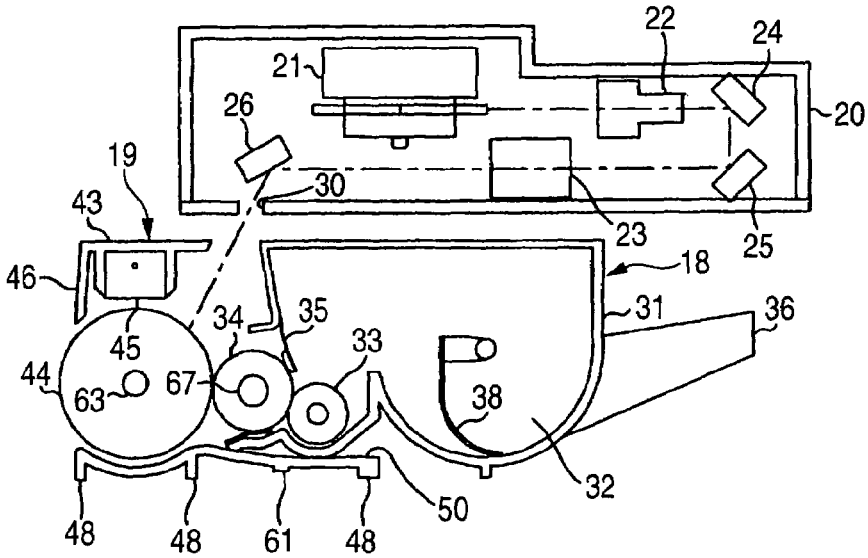
FIG. 14 is an enlarged sectional side view showing another embodiment of the developing unit of the color laser printer shown in FIG. 1.

Also, in the color laser printer 1, the grip portions 36 were disposed so as to project frontward from the scanner units 17 in a substantially vertical direction so that spaces were disposed above the grip portions 36 to secure space in which to operate the grip portions 36 when the photosensitive drum units 19 and the developing units 18 are loaded in the mainframe casing 2. However, as shown in FIG. 14, by disposing the grip portions 36 on lower portions of the rear walls of the developer casings 31 so that spaces are disposed between the grip portions 36 and the scanner units 17 disposed thereabove, space in which to operate the grip portions 36 can be secured even if the grip portions 36 do not project frontward in a substantially vertical direction from the scanner units 17 when the photosensitive drum units 19 and the developing units 18 are loaded in the mainframe casing 12.

As described above, according to an aspect of the invention, running costs and industrial waste can be reduced.

According to another aspect of the invention, the ease of replacing developing units can be improved.

According to another aspect of the invention, the loading and unloading of developing units and image carrying units can be secured.

According to another aspect of the invention, the attachment and detachment of developing units with respect to image carrying units can be improved.

According to another aspect of the invention, operability can be improved.

According to another aspect of the invention, loading and unloading are made easy and operability is improved.

According to another aspect of the invention, positional precision of the developing agent carriers with respect to the image carriers is good. As a result, color image formation can be excellently achieved.

According to another aspect of the invention, attachment and detachment of the developing units can be secured.

According to another aspect of the invention, the developing agent carriers can be disposed with good positional precision with respect to the image carriers even if the image carriers are loaded in the image forming apparatus mainframe.

According to another aspect of the invention, the loading and unloading of the image carrying units can be secured.

According to another aspect of the invention, just the developing unit or both of the developing unit and the image carrying unit can be loaded in unloaded from between the exposure units.

According to another aspect of the invention, the space of the area in which the apparatus is disposed can be economized.

According to another aspect of the invention, operability can be improved.

According to another aspect of the invention, just the developing units or both of the developing units and the image carrying units can be loaded in unloaded from between the exposure means.

According to another aspect of the invention, the number of parts can be reduced, the configuration of the apparatus can be simplified, and the apparatus can be made compact.

According to another aspect of the invention, the loading and unloading of the developing units with respect to the mainframe can be guided by a simple configuration.

According to another aspect of the invention, stable loading and unloading with respect to the image forming mainframe can be improved even if the developing units are formed long in the direction in which they are loaded and unloaded.

According to another aspect of the invention, operability during loading and unloading can be improved.

According to another aspect of the invention, the developing units and the image carrying units can be prevented from toppling over and these can be made easy to handle.

According to another aspect of the invention, the developing units and the image carrying units can be made even easier to handle.

According to another aspect of the invention, the number of parts can be reduced and both of the developing units and the image carrying units or just the image carrying units can be prevented from toppling over.

According to another aspect of the invention, the configuration of the apparatus can be simplified and the apparatus can be made compact.

According to another aspect of the invention, damage to and deterioration of the image carriers can be prevented.

According to another aspect of the invention, when the second opening/closing member is open, the image carriers can be prevented from being exposed in the space formed by that opening, so that damage to and deterioration of the image carriers can be prevented. When the second opening/closing member is closed, the image carrier is made to face the transfer unit supported at the second opening/closing member at the transfer position, so that the transfer operation can be conducted.

According to another aspect of the invention, the image carriers can be prevented from being exposed in the space formed by the opening of the second opening/closing member, so that damage to and deterioration of the image carriers can be prevented. Also, the image carriers are made to face the transfer means supported at the second opening/closing member at the transfer positions, so that the transfer operation can be conducted.

According to another aspect of the invention, the shutter member can be moved in association with the opening and closing operations of the second opening/closing member and moved to the covering position or the exposure position.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. An image forming apparatus, comprising:

a mainframe;

a plurality of developing units, each corresponding to a plurality of colors and each including a developing agent container that contains a developing agent and a developing agent carrier that carries the developing agent; and a plurality of image carrying units disposed correspondingly to the plurality of developing units and each including an image carrier that carries a developing agent image formed by an electrostatic latent image being developed by the developing agent carried on the developing agent carrier;

wherein each of the developing units is attachable to and detachable from the corresponding image carrying unit;

the developing units are loadable in and unloadable from the mainframe in a state where the developing units are integrally attached to the image carrying units; and each of the image carrying units is disposed separately from one another and is loadable in and unloadable from the mainframe independently from one another, wherein each of the image carrying units includes:

a shutter member movable between a cover position where the shutter member covers a transfer position to which the carried developing agent image is to be transferred and an exposure position where the shutter member exposes the transfer position: and an urging unit that urges the shutter member to the cover position.

2. The image forming apparatus of claim 1, wherein each of the developing units is attachable to and detachable from the corresponding image carrying unit loaded in the mainframe.

3. The image forming apparatus of claim 1, further comprising: a first opening/closing member that is openable and closeable with respect to the mainframe;

wherein the mainframe includes an opening that is opened and closed with the first opening/closing member;

the developing agent image carried on the image carrier is transferred at a transfer position;

the first opening/closing member is disposed at the opposite side of the transfer position of the image carrier; and the developing units and the image carrying units are loaded in and unloaded from the mainframe through the opening.

4. The image forming apparatus of claim 1, wherein each of the image carrying units has an engagement portion; and each of the developing units has an engaged portion engageable with the engagement portion.

5. The image forming apparatus of claim 4, wherein at least one of the developing units includes an operational portion configured to be operated to release the engagement between the engagement portion and the engaged portion.

6. The image forming apparatus of claim 1, wherein at least one of the developing units includes a grip portion used for gripping the developing unit.

7. The image forming apparatus of claim 6, wherein a space is disposed above the grip portion in a state where the at least one of the developing units is loaded in the mainframe.

8. The image forming apparatus of claim 1, wherein each of the image carrying units includes a first guide portion that guides the corresponding developing unit so that the developing agent carrier faces the image carrier; and the corresponding developing unit includes a guided portion that is guided by the first guide portion.

9. The image forming apparatus of claim 8, wherein the mainframe includes a second guide portion that guides the loading and unloading of the developing units.

10. The image forming apparatus of claim 9, wherein the second guide portion guides the guided portion of each of the developing units so that the guided portion is guided to a guide starting position of the first guide portion of the corresponding image carrying unit loaded in the mainframe.

11. The image forming apparatus of claim 9, wherein the mainframe includes a third guide portion that guides the loading and unloading of each of the image carrying units.

12. The image forming apparatus of claim 11, wherein the second guide portion and the third guide portion face each of the developing units, at both axial-direction sides of the developing agent carrier.

13. The image forming apparatus of claim 12, wherein the developing agent container includes a plurality of developing agent conveyance members that are arranged at predetermined intervals in the loading and unloading direction of each of the developing units; and each of the developing units includes engagement members that engage with the second guide portion in the vicinity of a position corresponding to the developing agent carrier and in the vicinity of a position corresponding to the developing agent conveyance member that is farthest from the developing agent carrier.

14. The image forming apparatus of claim 1, further comprising:

a plurality of exposure units that are disposed in correspondence to the image carriers to form the electrostatic latent images.

15. The image forming apparatus of claim 14, wherein the developing units and the exposure units are arranged alternately.

16. The image forming apparatus of claim 15, wherein the developing units and the exposure units are arranged in a substantially vertical direction.

17. The image forming apparatus of claim 15, further comprising:

a recording medium accommodating unit that accommodates a recording medium to which the developing agent image is transferred, the recording medium accommodating unit being loadable in and unloadable from the mainframe;

an operation panel used for operating the image forming apparatus; and the recording medium discharging unit that discharges the recording medium;

wherein a direction in which the recording medium accommodating unit is removed, a display direction of the operation panel, a direction in which the recording medium is discharged from the recording medium discharging unit, and a direction in which the developing units and the image carrying units are unloaded are substantially the same direction.

18. The image forming apparatus of claims 14, wherein each of the exposure units includes a casing having a casing surface; and the second guide portion and the third guide portion are disposed so as to be substantially parallel to the casing surface.

19. The image forming apparatus of claim 14, wherein each of the exposure units includes a casing having a casing surface; and the casing surface doubles as a guide member of each of the image carrying units.

20. The image forming apparatus of claim 1, wherein each of the developing units and the corresponding image carrying unit thereof are integrally attachable with each other while being unloaded from the mainframe; and each of the developing units and the corresponding image carrying unit include abutment portions that abut against a placement surface.

21. The image forming apparatus of claim 20, wherein each of the developing units and the corresponding image carrying unit are independently placeable by the abutment portions.

22. The image forming apparatus of claim 20, wherein each of the image carrying units includes a cover portion that covers at least a part of the corresponding developing unit; and the cover portion includes one of the abutment portions.

23. The image forming apparatus of claim 1, wherein developing agent remaining on the image carrier is recovered by the developing agent carrier after the developing agent image carried on the image carrier has been transferred to a transfer medium.

an urging unit that urges the shutter member to the cover position.

24. The image forming apparatus of claim 1, further comprising:

a transfer unit that transfers, at the transfer position, the developing agent image carried on the image carrier to the transfer medium;

a second opening/closing member that is provided at the mainframe so as to be openable and closeable and that supports the transfer unit; and the shutter moving unit that moves the shutter member to the exposure position when the second opening/closing member is closed and that moves the shutter member to the cover position when the second opening/closing member is open.

* * * * *